United States Patent [19]

Willcocks

[11] 3,944,735

[45] Mar. 16, 1976

[54] DIRECTIONAL ENHANCEMENT SYSTEM FOR QUADRAPHONIC DECODERS

[75] Inventor: Martin Edmund George Willcocks, Somersham, England

[73] Assignees: John C. Bogue, Santa Monica; Wesley Ruggles, Jr., Beverley Hills, both of Calif.

[22] Filed: May 22, 1974

[21] Appl. No.: 472,291

[52] U.S. Cl. ..... 179/1 GQ; 179/100.4 ST

[51] Int. Cl.[2] ..... H04R 5/00

[58] Field of Search ..... 179/1 GQ, 1 G, 100.4 ST, 179/15 BT

[56] References Cited

UNITED STATES PATENTS

| | | | |
|---|---|---|---|
| 3,786,193 | 1/1974 | Tsurushima | 179/1 GQ |
| 3,794,781 | 2/1974 | Bauer | 179/1 GQ |
| 3,798,373 | 3/1974 | Bauer | 179/1 GQ |
| 3,812,295 | 5/1974 | Bauer | 179/1 GQ |
| 3,821,471 | 6/1974 | Bauer | 179/1 GQ |
| 3,825,684 | 7/1974 | Ito et al. | 179/1 GQ |
| 3,829,615 | 8/1974 | Hiramatsu | 179/1 GQ |
| 3,836,715 | 9/1974 | Ito | 179/1 GQ |

*Primary Examiner*—Douglas W. Olms
*Attorney, Agent, or Firm*—Witherspoon and Lane

[57] ABSTRACT

Method and apparatus for enhancing the directional content of information recorded or transmitted as four separate channels on a medium having only two independent tracks or channels and subsequently decoded into four signals each of which contains predominantly information pertaining to one of the four original channels but also information pertaining to others, in such a way that the resultant output signals when amplified and presented to four separate loudspeakers give the listener the illusion of four separate sources of sound. The system is characterized by detection apparatus which continuously recognizes the direction of the predominant sound source and produces corresponding control signals, processing apparatus which imposes suitable level-limiting and time-constant characteristics on these signals and generates therefrom a number of voltages representing the coefficients of a modifying matrix, and a matrix multiplier which multiplies the incoming four signals by the modifying matrix to obtain four output signals in which the directionality of the predominant sound source is enhanced. In particular, the coefficients of the modifying matrix generated by this system are such as to substantially reduce or remove the components of the predominant signal from all channels other than those in which it should appear while simultaneously producing no change in the total power output from the four loudspeakers resulting from any and all signals present. Furthermore the presence of signals corresponding to sound sources in other directions than the principal ones represented by the four loudspeakers can be detected and result in a modifying matrix which enhances their directionality, and the simultaneous presence of sufficiently distinct signals in more than one channel can also result in a modifying matrix which enhances their directions, thereby creating a substantially perfect impression of independent sound sources in their originally intended locations. The system is applicable to the decoded signals obtained from a simple matrix decoder using and 4-2-4 quadraphonic matrix encoding and decoding system.

33 Claims, 12 Drawing Figures

DIRECTIONAL ENHANCEMENT SYSTEM FOR QUADRAPHONIC DECODERS

BACKGROUND OF THE INVENTION

This invention relates to apparatus for reproducing four separate channels of information after recording or transmission on a medium having only two tracks, and presenting it on four loudspeakers to give the listener the illusion of sound coming from a corresponding number of separate sources. More particularly, the present invention is concerned with the modification of the four signals obtained from a preceding quadraphonic matrix decoder not forming part of the invention in such a way as to enhance the directional content of said signals before presenting them to the loudspeakers.

Previous methods of enhancing the directionality of such signals have been incorporated as part of the matrix decoder and designed and intended for use with one particular quadraphonic system such as the SQ system of Columbia Broadcasting System, Inc. and the QS system of Sansui Electric Co., Ltd. The present invention differs from these in that it accepts the four outputs from a simple matrix decoder operating on any such system, and does not therefore include a 2–4 matrix decoder as such. Although there are differences in the mathematical formulation of the various systems, it is possible for the enhancement system to operate effectively with any system and to be switched from one system to another with only minor changes in the detailed circuitry. The enhancement system operates on the same principles whatever quadraphonic matrix is used.

In previous types of logic-directed decoders or similar systems, the approach has either been piecemeal resulting in only modest improvements, or has been unable to carry out the function of separating the signals whilst at the same time maintaining absolute constancy of the total power output due to any source being reproduced. This is important because the psychoacoustic effect on which such systems depend is sensitive to variation of the total power. By adopting a holistic approach to the problem, a new mathematical basis has been formulated for the enhancement system, and the method thus devised has been implemented in a novel way.

Previous systems of this kind have employed devices such as variable gain amplifiers, photoconductive cells or field-effect transistors to accomplish the limited objectives. In some cases, little effort has been made to reduce unwanted effects such as harmonic distortion. One of the features of the present invention is that it can be embodied in a way which maintains very low harmonic distortion, and is therefore compatible with the best high fidelity sound reproducers.

The invention also embodies improved methods of detecting the direction of the predominant signals and for imposing suitable limiting and attack-decay characteristics on the control signals thus obtained.

While the invention is primarily designed for use in a quadraphonic sound system, the invention has broader utility in that it can be used to enhance the directionality of any such signals having directional information. The enhanced signals could then be applied to an appropriate device other than a loudspeaker. For instance, the method of this invention could be applied to a known communication system in which five separate transmission channels are employed to carry ten simultaneous messages, each message being transmitted on a different pair of the five channels. Further, the method of this invention is not limited to any specific number of channels.

SUMMARY OF THE INVENTION

An understanding of the elements of matrix algebra is necessary for full comprehension of the operating principles of the invention.

MATHEMATICAL PRINCIPLES OF THE SYSTEM

The encoding and decoding processes employed in a quadraphonic 4-2-4 matrix system can be represented in the notation of matrix algebra. In this notation, the four original signals are represented as a column vector $s$ of four elements $s_1$, $s_2$, $s_3$ and $s_4$. These elements have values which vary with time in accordance with the signals in the corresponding channels. For the purposes of this argument the left front channels will be regarded as channel 1, the right front as channel 2, the right back as channel 3 and the left back as channel 4.

The encoded pair of signals is also represented as a column vector $e$ having two elements $e_1$ and $e_2$ corresponding to the left and right channels of the stereophonic recording or transmission medium respectivey. The encoding process is represented by a rectangular array or matrix of eight coefficients with double subscripts. This matrix E has coefficients $e_{11}$, $e_{12}$, $e_{13}$, $e_{14}$, $e_{21}$, $e_{22}$, $e_{23}$ and $e_{24}$ where the first subscript refers to the row and the second to the column in which the element appears. The complete encoding process is represented in full by the matrix equation:

$$\begin{bmatrix} e_1 \\ e_2 \end{bmatrix} = \begin{bmatrix} e_{11} & e_{12} & e_{13} & e_{14} \\ e_{21} & e_{22} & e_{23} & e_{24} \end{bmatrix} \begin{bmatrix} s_1 \\ s_2 \\ s_3 \\ s_4 \end{bmatrix} \quad (1)$$

in which the juxtaposition of the two matrices on the right-hand side means that the matrices are to be multiplied together in accordance with the normal mathematical convention, giving the following equations for $e_1$ and $e_2$:

$$e_1 = e_{11}s_1 + e_{12}s_2 + e_{13}s_3 + e_{14}s_4 \quad (2)$$

$$e_2 = e_{21}s_1 + e_{22}s_2 + e_{23}s_3 + e_{24}s_4 \quad (3)$$

In abbreviated matrix notaton, this operation is represented by the equation:

$$e = E\,s \quad (4)$$

The four decoded signals are represented by the column vector $d$ and the decoding process by the matrix D which has eight elements $d_{11}$ to $d_{42}$ arranged in four rows by two columns. The decoding equation is represented by :

$$d = D\,e \quad (5)$$

The overall process corresponds to a transformation from the original signals $s$ to the decoded signals $d$ which can be represented by a 4-row by 4-column matrix $T_o$ in the equation:

$$d = T_o s \quad (6)$$

The matrix $T_o$ is the product of D and E, i.e.:

$$T_o = D\,E \tag{7}$$

It is important that in an equation of this kind matrix $T_o$ has as many rows as D and as many columns as E, and in his case it represents four separate equations like (2) and (3). Furthermore, the order of D and E is important.

To enhance the directionality of the decoded signals it is necessary to modify them by an additional process. If the modified signals are represented by the 4-element column vector $m$ and the modifying process by the matrix M, having 4 rows and 4 columns, the modification can be represented by the equation:

$$m = M\,d \tag{8}$$

$$= T\,s \tag{9}$$

where T is the 4×4 transformation matrix from the original signals to the modified decoded signals, and $$T = M\,T_o \tag{10}$$

From this it can be seen that the required process is a matrix multiplication, i.e the decoded signals treated as a group of four are multiplied by the coefficients $m_{11}$ to $m_{44}$ of the modifying matrix M and summed to give the four modified signals m. The values of the coefficients of M vary with the perceived direction of the predominant sound source and also depend on the particular coefficients of $T_o$ which represents the qudraphonic matrix system.

For an ideal quadraphonic system, each output channel consists entirely of the corresponding input channel so the transformation would be represented by the identity matrix I, thus:

$$T = I = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \tag{11}$$

In this case the modifying matrix would also be I, and it is often convenient electrically to split the modifying matrix up into two components:

$$M = B + I \tag{12}$$

where the elements of B not the main diagonal are equal to the corresponding elements of M, but those on the main diagonal are 1 less than corresponding elements of M.

To distinguish the controlling direction of M, it will be used as predominant subscript with centre front at 0° and direction angle increasing clockwise so that left front is at 315°. The modifying matrix for a predeterminant left front signal will be called $M_{315}$.

The transformation matrix T must satisfy two requirements: the primary signal must be confined to the speaker or pair of speakers which can reproduce its direction precisely, and eliminated from all others, and this must be done without changing the total power output of the system for either the primary signal or for any other signals present.

APPLICATION TO THE SQ SYSTEM

By way of example, the foregoing mathematical principles are applied to the SQ system below. The encoding matrix for SQ is:

$$E = \begin{bmatrix} 1 & 0 & 0.707 & -j0.707 \\ 0 & 1 & j0.707 & -0.707 \end{bmatrix} \tag{13}$$

and the decoding matrix is:

$$D = \begin{bmatrix} 1 & 0 \\ 0 & 1 \\ 0.707 & -j0.707 \\ j0.707 & -0.707 \end{bmatrix} \tag{14}$$

so from equation (7) the overall transformation is represented by:

$$T_o = \begin{bmatrix} 1 & 0 & 0.707 & -j0.707 \\ 0 & 1 & j0.707 & -0.707 \\ 0.707 & -j0.707 & 1 & 0 \\ j0.707 & -0.707 & 0 & 1 \end{bmatrix} \tag{15}$$

In this representation the element in the third row and first column, for example, represents the relative signal level in the third or right back loudspeaker due to a sound signal in the first or left front channel, and the letter $j$ represents the square root of −1 corresponding to a phase angle of 90°. The relative power in each speaker can be ascertained by squaring the absolute values of the elements. Thus, the relative powers in the first, second, third and fourth speakers due to a signal in the first channel are the squares of the first, second, third and fourth elements of the first column; in this context only the magnitudes of these squares are relevant so the powers in the four speakers are 1, 0, 0.5 and 0.5 respectively, making a total power of 2 units. Carrying out the same operations on the other columns also gives the figure of 2 units for the total relative power due to sources placed at right front, right back or left back. The relative powers due to sources in a position midway between two speakers can be calculated, by adding two columns corresponding to the speakers, squaring the magnitudes of the four sums thus obtained and taking half the result; thus, a center front signal produces 0.5 units of relative power in each speaker, again totaling 2 units, and the same total is found for center left, center right and center back sources.

The presence of a zero in any element implies that the speaker corresponding to the row produces no output when the system reproduces a sound source in the position corresponding to the column.

It follows that the requirements imposed on the transformation matrix are that the elements in the column or columns corresponding to the source position and the row or rows corresponding to the speakers which are necessary for the reproduction of the sound source should be non-zero, and the elements in the same column or columns and all other rows should be zero. Furthermore, the sum of the squares of the magnitudes of the elements in each column should be 2, and the total relative power for sources midway between the speakers as defined above should also be 2.

These requirements partially define the elements of the modifying matrix, but because the transformation matrix $T_o$ is singular (i.e. it cannot have a mathematical inverse) ther is a certain freedom of choice of these elements. To derive the modifying matrix for a left front signal, $M_{315}$, we note that the signals present in the two back channels must be canceled by adding a suitable proportion of the signal in the left front channel in an appropriate phase, and the signal in the left front channel must be increased to compensate for the reduction in total power which would otherwise occur. Furthermore, the gains of the other channels may need to be altered accordingly. Thus, the modifying matrix may have the form:

$$M_{315} = \begin{bmatrix} k_1 & 0 & 0 & 0 \\ 0 & k_2 & 0 & 0 \\ k_3 & 0 & k_4 & 0 \\ k_5 & 0 & 0 & k_6 \end{bmatrix} \quad (16)$$

where the coefficients $K_1$ to $K_6$ are to be found. The corresponding transformation matrix $T_{315}$ defined by equation (10) is:

$$T_{315} = \begin{bmatrix} k_1 & 0 & 0.707k_1 & -j0.707k_1 \\ 0 & k_2 & j0.707k_2 & -0.707k_2 \\ k_3+0.707k_4 & -j0.707k_4 & 0.707k_3+k_4 & -j0.707k_4 \\ k_5+j0.707k_6 & -0.707k_6 & 0.707k_5 & -j0.707k_5+k_6 \end{bmatrix} \quad (17)$$

with the requirements that:

$$k_3+0.707k_4 = 0 \quad (18)$$

$$k_5+j0.707k_6 = 0 \quad (19)$$

$$k_1 = 2 \quad (20)$$

corresponding to cancellation of the left front signal in the right back and left back channels and a total power of 2 units in the four speakers due to the left front source.

Substituting these requirements into equation (17) leads to the simplified matrix:

$$T_{315} = \begin{bmatrix} 1.414 & 0 & 1 & -j \\ 0 & k_2 & j0.707k_2 & -0.707k_2 \\ 0 & -j0.707k_4 & 0.5k_4 & j0.5k_4 \\ 0 & -0.707k_6 & -j0.5k_6 & 0.5k_6 \end{bmatrix} \quad (21)$$

The requirement that the sum of the squares of the magnitudes of the elements of each column should be 2 gives the equation:

$$k_2^2 + 0.5k_4^2 + 0.5k_6^2 = 2 \quad (22)$$

and this also satisfies the requirements for central sources so there are two arbitrary choices available at this point. Referring to equation (15) the total power in each speaker due to unit incoherent sources placed in each corner is 2 units. Equation (21) indicates that the total power in the left front speaker due to this combination of sources, obtained by summing the squares of the magnitudes of the elements in the first row, is 4 units. Since the total power from all four speakers is to be unchanged and was previously 8 units, the remaining 4 units have to be shared out among the other three speakers in an acceptable way. This is an arbitrary choice, but logically it would be reasonable to divide the power equally between them so that:

$$2k_2^2 = k_4^2 = k_6^2 = 1.333 \quad (23)$$

which gives the values $k_2 = 0.817$, $k_4 = k_6 = 1.155$, and the modifying matrix is therefore:

$$M_{315} = \begin{bmatrix} 1.414 & 0 & 0 & 0 \\ 0 & 0.817 & 0 & 0 \\ -0.817 & 0 & 1.155 & 0 \\ -j0.817 & 0 & 0 & 1.155 \end{bmatrix} \quad (24)$$

The corresponding transformation matrix is therefore:

$$T_{315} = \begin{bmatrix} 1.414 & 0 & 1 & -j \\ 0 & 0.817 & j0.577 & -0.577 \\ 0 & -j0.817 & 0.577 & j0.577 \\ 0 & -0.817 & -j0.577 & 0.577 \end{bmatrix} \quad (25)$$

The electrically inconvenient imaginary term $-j0.817$ in $M_{315}$ can be removed by noting that the left back signal is $-0.817$ times the original right front signal so that an alternative form of $M_{315}$ is:

$$M_{315} = \begin{bmatrix} 1.414 & 0 & 0 & 0 \\ 0 & 0.817 & 0 & 0 \\ -0.817 & 0 & 1.155 & 0 \\ 0 & -0.817 & 0 & 0 \end{bmatrix} \quad (26)$$

The corresponding matrix $B_{315}$ is therefore:

$$B_{315} = \begin{bmatrix} 0.414 & 0 & 0 & 0 \\ 0 & -0.183 & 0 & 0 \\ -0.817 & 0 & 0.155 & 0 \\ 0 & -0.817 & 0 & -1 \end{bmatrix} \quad (27)$$

where $B_{315}$ and $M_{315}$ are related by equation (12).

Similar reasoning leads to the modifying matrices for the other three corner signals which are:

$$M_{45} = \begin{bmatrix} 0.817 & 0 & 0 & 0 \\ 0 & 1.414 & 0 & 0 \\ 0.817 & 0 & 0 & 0 \\ 0 & 0.817 & 0 & 1.155 \end{bmatrix} \quad (28)$$

$$M_{135} = \begin{bmatrix} 1.155 & 0 & -0.817 & 0 \\ 0 & 0 & 0 & -0.817 \\ 0 & 0 & 1.414 & 0 \\ 0 & 0 & 0 & 0.817 \end{bmatrix} \quad (29)$$

$$M_{225} = \begin{bmatrix} 0 & 0 & 0.817 & 0 \\ 0 & 1.155 & 0 & 0.817 \\ 0 & 0 & 0.817 & 0 \\ 0 & 0 & 0 & 1.414 \end{bmatrix} \quad (30)$$

for right front, right back and left back predominant sources respectively. The corresponding B matrices are:

$$B_{45} = \begin{bmatrix} -0.183 & 0 & 0 & 0 \\ 0 & 0.414 & 0 & 0 \\ 0.817 & 0 & -1 & 0 \\ 0 & 0.817 & 0 & 0.155 \end{bmatrix} \quad (31)$$

$$B_{135} = \begin{bmatrix} 0.155 & 0 & -0.817 & 0 \\ 0 & -1 & 0 & -0.817 \\ 0 & 0 & 0.414 & 0 \\ 0 & 0 & 0 & -0.183 \end{bmatrix} \quad (32)$$

$$B_{225} = \begin{bmatrix} -1 & 0 & 0.817 & 0 \\ 0 & 0.155 & 0 & 0.817 \\ 0 & 0 & -0.183 & 0 \\ 0 & 0 & 0 & 0.414 \end{bmatrix} \quad (33)$$

For a center front source, the transferred signals in the rear channels are in antiphase and can therefore be canceled by summing them. This procedure does not change the output powers of the transferred signals from the front corners because these signals are in quadrature. It would be better, therefore, to reduce the gain of the rear channels as well. In the front channels the center front signal must be increased to compensate for its reduction in the rear, while the front corners should also be increased somewhat if the rear transferred signals are reduced. A suitable form of the modifying matrix will be symmetric (about the main diagonal) and of the form:

$$M_0 = \begin{bmatrix} k_1 & k_2 & 0 & 0 \\ k_2 & k_1 & 0 & 0 \\ 0 & 0 & k_3 & k_3 \\ 0 & 0 & k_3 & k_3 \end{bmatrix} \quad (34)$$

and the corresponding transformation matrix $T_0$ [not to be confused with $T_o$ defined in equation (15)] is:

$$T_0 = \begin{bmatrix} k_1 & k_2 & 0.707k_1+j0.707k_2 & -0.707k_2-j0.707k_1 \\ k_2 & k_1 & 0.707k_2+j0.707k_1 & -0.707k_2-j0.707k_1 \\ 0.707k_3(1+j) & -0.707k_3(1+j) & k_3 & k_3 \\ 0.707k_3(1+j) & -0.707k_3(1+j) & k_3 & k_3 \end{bmatrix} \quad (35)$$

The requirements for constant total power give the equation:

$$k_1^2 + k_2^2 + 2k_3^2 = 2 \quad (36)$$

and for the center front signal:

$$(k_1 + k_2)^2 = 2 \quad (37)$$

The center back signal gives no new information, nor do any different equations arise from center side signals, and it follows that any values of $k_1$, $k_2$ and $k_3$ which satisfy the above equations will also result in preservation of the total powers due to sources in these positions. The arbitrary choice in this case is to leave the gains of the front corner channels unchanged, making $k_1 = 1$, $k_2 = 0.414$ and $k_3 = 0.644$. The modifying matrix becomes:

$$M_0 = \begin{bmatrix} 1 & 0.414 & 0 & 0 \\ 0.414 & 1 & 0 & 0 \\ 0 & 0 & 0.644 & 0.644 \\ 0 & 0 & 0.644 & 0.644 \end{bmatrix} \quad (38)$$

and the corresponding B matrix is:

$$B_0 = \begin{bmatrix} 0 & 0.414 & 0 & 0 \\ 0.414 & 0 & 0 & 0 \\ 0 & 0 & -0.356 & 0.644 \\ 0 & 0 & 0.644 & -0.356 \end{bmatrix} \quad (39)$$

Similarly, for center back signals the modifying matrix is:

$$M_{180} = \begin{bmatrix} 0.644 & 0.644 & 0 & 0 \\ 0.644 & 0.644 & 0 & 0 \\ 0 & 0 & 1 & 0.414 \\ 0 & 0 & 0.414 & 1 \end{bmatrix} \quad (40)$$

and the corresponding B matrix is given by:

$$B_{180} = \begin{bmatrix} -0.356 & 0.644 & 0 & 0 \\ 0.644 & -0.356 & 0 & 0 \\ 0 & 0 & 0 & 0.414 \\ 0 & 0 & 0.414 & 0 \end{bmatrix} \quad (41)$$

Similar arguments and reasoning applied to the center left and center right signals when encoded by means of panpots as distinct from the use of an SQ position encoder give the modifying matrices:

$$M_{90} = M_{270} = \begin{bmatrix} 0.707 & 0 & 0 & 0.707 \\ 0 & 0.707 & 0.707 & 0 \\ 0 & 0.707 & 0.707 & 0 \\ 0.707 & 0 & 0 & 0.707 \end{bmatrix} \quad (42)$$

and the corresponding B matrices:

$$B_{90} = B_{270} = \begin{bmatrix} -0.293 & 0 & 0 & 0.707 \\ 0 & -0.293 & 0.707 & 0 \\ 0 & 0.707 & -0.293 & 0 \\ 0.707 & 0 & 0 & -0.293 \end{bmatrix} \quad (43)$$

and for position encoded center left and center right signals the appropriate modifying matrices and B matrices are:

$$M_{90}' = M_{270}' = \begin{bmatrix} 0.924 & 0.383 & -0.383 & 0.924 \\ -0.383 & 0.924 & 0.924 & 0.383 \\ -0.383 & 0.924 & 0.924 & 0.383 \\ 0.924 & 0.383 & -0.383 & 0.924 \end{bmatrix} \quad (44)$$

$$B_{90}' = B_{270} = \begin{bmatrix} -0.076 & 0.383 & -0.383 & 0.924 \\ -0.383 & -0.076 & 0.924 & 0.383 \\ -0.383 & 0.924 & -0.076 & 0.383 \\ 0.924 & 0.383 & -0.383 & -0.076 \end{bmatrix} \quad (45)$$

It is possible to deduce modifying matrices which have similar characteristics for other directions than those above. It will be noted that all the coefficients of the B matrices are of magnitude less than or equal to 1, with the practical consequence that the process of matrix multiplication can be implemented electronically quite easily.

By producing control signals $c_0, c_{45}, c_{90}, \ldots, c_{315}$, each of which takes on a value of 1 when a signal from the corresponding direction occurs or 0 when the predominant signal is from a different direction, the matrix control coefficients can be written as a linear combination of the B matrices, $$B(t) = \sum_{\theta} c_{\theta}\ (t) B_{\theta} \tag{46}$$

Thus the modifying matrix as a function of time is given by $$M(t) = B(t) + I \tag{46-1}$$

and if the sum of the control coefficients is always equal to 1, it follows that $$M(t) = \Sigma c\ (t) M \tag{46-2}$$

in which the time dependence of B is related to the variation of the control parameters with time as the predominant signals change. Furthermore, if the control parameters are allowed to take intermediate values when the predominant signal source lies between two directions for which control parameters are provided, a modifying matrix results which is reasonably effective in suppressing the transferred signals and at maintaining the total power constant. This means that quite a small number of control signals can be used in the interest of simplicity. It is also possible that if control signals are present from two different directions simultaneously the resultant modifying matrix will have characteristics which partially suppress the transferred signals due to both sound sources, although in these cases the total power output will vary to some extent.

For example, if signals are provided for left front and left back and these signals take on the value 0.5 when a center left position encoded signal is present, the resultant B matrix is:

$$B''_{270} = 0.5B_{225} + 0.5B_{315} \tag{47}$$

$$= \begin{bmatrix} -0.293 & 0 & 0.408 & 0 \\ 0 & -0.014 & 0 & 0.408 \\ -0.408 & 0 & -0.014 & 0 \\ 0 & -0.408 & 0 & -0.293 \end{bmatrix} \tag{48}$$

and the corresponding modifying matrix is:

$$M''_{270} = \begin{bmatrix} 0.707 & 0 & 0.408 & 0 \\ 0 & 0.986 & 0 & 0.408 \\ -0.408 & 0 & 0.986 & 0 \\ 0 & -0.408 & 0 & 0.707 \end{bmatrix} \tag{49}$$

The transformation matrix defined by equation (10) is:

$$T''_{270} = \begin{bmatrix} 0.996 & -j0.289 & 0.908 & -j0.500 \\ j0.289 & 0.697 & j0.697 & -0.289 \\ 0.289 & -j0.697 & 0.697 & j0.289 \\ j0.500 & -0.908 & -j0.289 & 0.996 \end{bmatrix} \tag{50}$$

Summing the squares of the column elements shows that the total power due to corner sources falls to 1.41 for left corners and 1.88 for right corners, but a position encoded center left signal has equivalent components of $s$ of 0.924, 0.383, -0.383, 0.924 applied to the four inputs of the encoder and the resultant output signal from the matrix multiplier will therefore be $0.573(1-j)$, 0, 0, $0.573(1+j)$. The center left signal is thus completely suppressed in the right channels, although total power is reduced by about 1.8dB. It is also clear that, if the above control signals had been produced by two signals, one in each of left front and left back channels, the separation of these two signals would have been increased from the basic 3dB to 6dB since $t_{11}$ and $t_{44}$ are 0.996 and $t_{14}$ and $t_{41}$ have magnitudes of 0.5

The coefficients of the matrix B of equation (46) are defined below in terms of the conrol coefficients and the elements of the B matrices corresponding thereto, from equations (27), (31) to (33), (39), (41), (43) and (45)

$$b_{11} = -0.183c_{45} - 0.293c_{90} - 0.076c'_{90} + 0.155c_{135} - 0.356c_{180} - c_{225} - 0.293c_{270} - 0.076c'_{270} + 0.414c_{315} \tag{46a}$$

$$b_{12} = 0.414c_0 0.383c'_{90} + 0.644c_{180} + 0.383c'_{270} \tag{46b}$$

$$b_{13} = -0.383c'_{90} - 0.817c_{135} + 0.817c_{225} - 0.383c'_{270} \tag{46c}$$

$$b_{14} = 0.707c_{90} + 0.924c'_{90} + 0.707c_{270} + 0.924c'_{270} \tag{46d}$$

$$b_{21} = 0.414c_0 - 0.383c'_{90} + 0.644c_{180} - 0.383c'_{270} \tag{46e}$$

$$b_{22} = 0.414c_{45} - 0.293c_{90} - 0.076c'_{90} - c_{135} - 0.356c_{180} + 0.155c_{225} - 0.293c_{270} - 0.076c'_{270} - 0.183c_{315} \tag{46f}$$

$$b_{23} = 0.707c_{90} + 0.924c'_{90} + 0.707c_{270} + 0.924'_{270} \tag{46g}$$

$$b_{24} = 0.383c'_{90} - 0.817c_{135} + 0.817c_{225} + 0.383c'_{270} \tag{46h}$$

$$b_{31} = 0.817c_{45} - 0.383c'_{90} - 0.383c'_{270} - 0.817c_{315} \tag{46i}$$

$$b_{32} = 0.707c_{90} + 0.924c'_{90} + 0.924c'_{270} + 0.707c_{270} \tag{46j}$$

$$b_{33} = -0.356c_0 - c_{45} - 0.293c_{90} - 0.076c'_{90} + 0.414c_{135} - 0.183c_{225} - 0.293c_{270} - 0.076c'_{270} + 0.155c_{315} \tag{46k}$$

$$b_{34} = 0.644c_0 + 0.383c'_{90} + 0.414c_{180} + 0.383c'_{270} \tag{46l}$$

$$b_{41} = 0.707c_{90} + 0.924c'_{90} + 0.707c_{270} + 0.924c'_{270} \tag{46m}$$

$$b_{42} = 0.817c_{45} + 0.383c'_{90} + 0.383c'_{270} - 0.817c_{315} \tag{46n}$$

$$b_{43} = 0.644c_0 - 0.383c'_{90} + 0.414c_{180} - 0.383c'_{270} \tag{46o}$$

$$b_{44} = -0.356c_0 + 0.155c_{45} - 0.293c_{90} - 0.076c'_{90} - 0.183c_{135} + 0.414c_{225} - 0.293c_{270} - 0.076c'_{270} - c_{315} \tag{46p}$$

For the simplified embodiment with centre left and right controls omitted, these simplify to:

$$b_{11} = -0.183c_{45} + 0.155c_{135} - 0.356c_{180} - c_{225} + 0.414c_{315} \tag{46q}$$

$$b_{12} = b_{21} = 0.414c_0 + 0.644c_{180} \tag{46r}$$

$$b_{13} = b_{24} = -0.817c_{135} + 0.817c_{225} \tag{46s}$$

$$b_{14} = b_{23} = b_{32} = b_{41} = 0 \tag{46t}$$

$$b_{22} = 0.414c_{45} - c_{135} - 0.356c_{180} + 0.155c_{225} - 0.183c_{315} \quad (46u)$$

$$b_{31} = b_{42} = 0.817c_{45} - 0.817c_{315} \quad (46v)$$

$$b_{33} = -0.356c_0 - c_{45} + 0.414c_{135} - 0.183c_{225} + 0.155c_{315} \quad (46w)$$

$$b_{34} = b_{43} = 0.644c_0 + 0.414c_{180} \quad (46x)$$

$$b_{44} = -0.356c_0 + 0.155c_{45} - 0.183c_{135} + 0.414c_{225} - c_{315} \quad (46y)$$

APPLICATION TO THE QS SYSTEM

In the QS system the overall transformation is represented by the matrix:

$$T_o = \begin{bmatrix} 1 & 0.707 & 0 & j0.707 \\ 0.707 & 1 & -j0.707 & 0 \\ 0 & j0.707 & 1 & 0.707 \\ -j0.707 & 0 & 0.707 & 1 \end{bmatrix} \quad (51)$$

By very similar reasoning to that adopted for the SQ system, the modifying matrices for the corner channels are found to be:

$$M_{315} = \begin{bmatrix} 1.414 & 0 & 0 & 0 \\ -0.817 & 1.155 & 0 & 0 \\ 0 & 0 & 0.817 & 0 \\ 0 & 0 & 0.817 & 0 \end{bmatrix} \quad (52)$$

$$M_{45} = \begin{bmatrix} 1.155 & -0.817 & 0 & 0 \\ 0 & 1.414 & 0 & 0 \\ 0 & 0 & 0 & 0.817 \\ 0 & 0 & 0 & 0.817 \end{bmatrix} \quad (53)$$

$$M_{135} = \begin{bmatrix} 0.817 & 0 & 0 & 0 \\ 0.817 & 0 & 0 & 0 \\ 0 & 0 & 1.414 & 0 \\ 0 & 0 & -0.817 & 1.155 \end{bmatrix} \quad (54)$$

$$M_{225} = \begin{bmatrix} 0 & 0.817 & 0 & 0 \\ 0 & 0.817 & 0 & 0 \\ 0 & 0 & 1.155 & -0.817 \\ 0 & 0 & 0 & 1.414 \end{bmatrix} \quad (55)$$

Again by similar reasoning to that of the SQ case, suitable modifying matrices for the centre front and centre back signals are:

$$M_0 = \begin{bmatrix} 0.765 & 0.317 & 0 & 0 \\ 0.317 & 0.765 & 0 & 0 \\ 0 & 0 & 0.533 & 0.533 \\ 0 & 0 & 0.533 & 0.533 \end{bmatrix} \quad (56)$$

$$M_{180} = \begin{bmatrix} 0.533 & 0.533 & 0 & 0 \\ 0.533 & 0.533 & 0 & 0 \\ 0 & 0 & 0.765 & 0.317 \\ 0 & 0 & 0.317 & 0.765 \end{bmatrix} \quad (57)$$

Each of the above matrices are dependent on an arbitrary choice of some design parameter, as in the case of SQ, and these matrices are designed to give essentially similar performance characteristics in the two cases. For the centre left and centre right signals, it can be shown that the modifying matrices must be different, and a possible matrix for centre right is:

$$M_{90} = \begin{bmatrix} 0.707 & 0 & 0 & -0.707 \\ 0 & 0.707 & 0.707 & 0 \\ 0 & 0.707 & 0.707 & 0 \\ 0.707 & 0 & 0 & -0.707 \end{bmatrix} \quad (58)$$

and for center left, $$M_{270} = \begin{bmatrix} 0.707 & 0 & 0 & 0.707 \\ 0 & -0.707 & 0.707 & 0 \\ 0 & -0.707 & 0.707 & 0 \\ 0.707 & 0 & 0 & 0.707 \end{bmatrix} \quad (59)$$

The corresponding B matrices are defined by equation (12).

In a similar manner, the matrices required to modify the output signals of any other quadraphonic phase matrix such as BMX can be deduced. Also, as has been mentioned, the described system can be utilized to enhance the output signals from any device providing output signals containing directional information.

BRIEF DESCRIPTION OF THE DRAWING

The exact nature and details of the invention can be obtained from the following detailed description of the invention when read in conjunction with the annexed drawing in which.

DETAILED DESCRIPTION OF THE INVENTION

Although the invention is applicable to any of a number of quadraphonic matrix systems, or for that matter to any matrix system where four signals having direction information are derived from a pair of sources containing this direction information, the invention will be described mainly in the context of the SQ system of Columbia Broadcasting System (CBS) and in addition a configuration of the detector of the invention when used with a QS system of Sansui Electric Co., Ltd. is also specifically disclosed.

Figure 1:
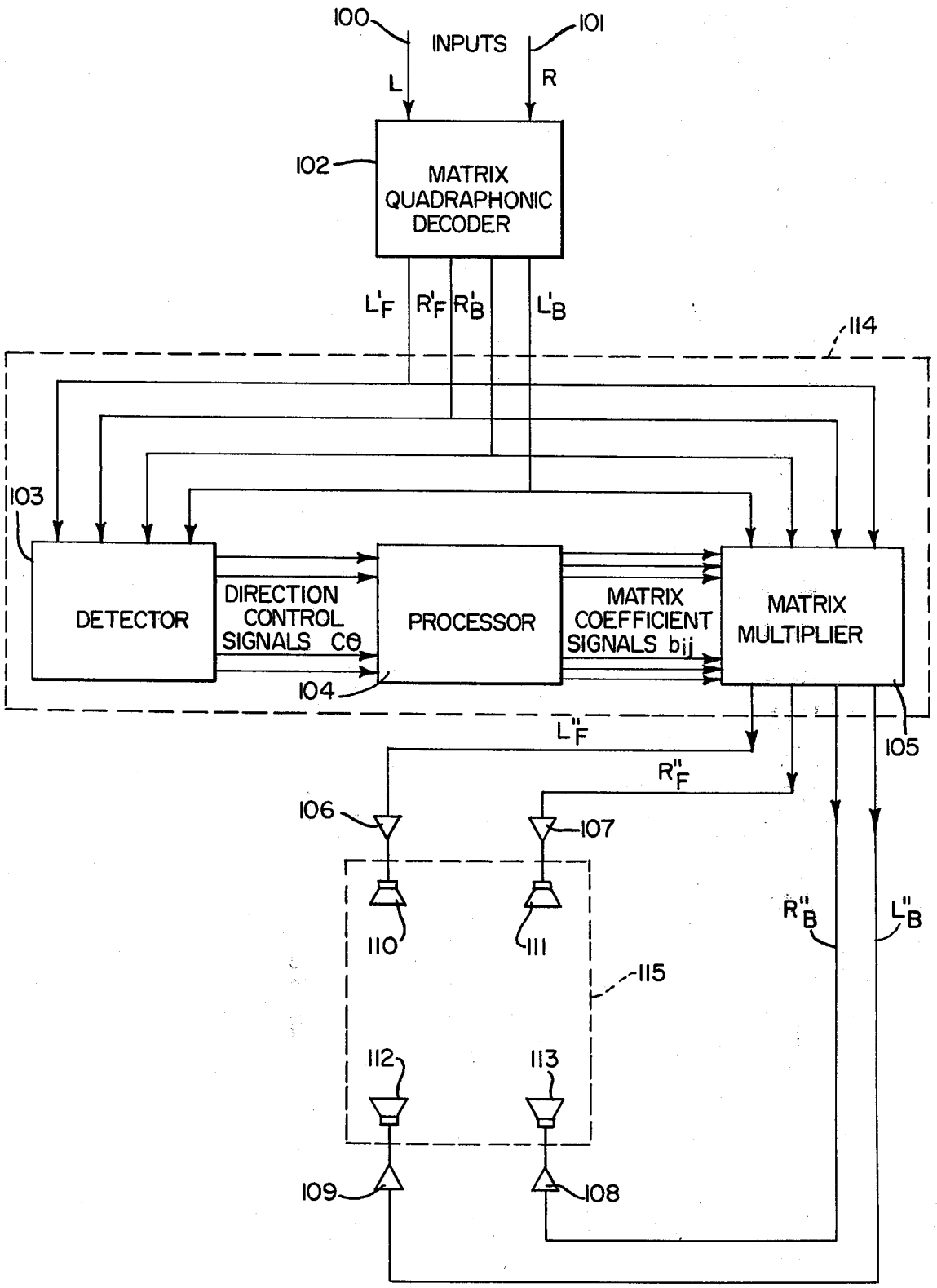
FIG. 1 is a block diagram showing a preferred embodiment of the invention in a quadraphonic sound system.

Referring to FIG. 1, this figure shows the invention in block diagram as used in a quadraphonic sound system. The invention is enclosed in the dotted box 114. The balance of elements in this figure show how the invention is connected in a quadraphonic sound system. That is, the elements outside of dotted box 114 represent a typical quadraphonic sound system in which the invention has been incorporated.

As shown in FIG. 1, a pair of input signals are applied to the leads 100 and 101. These signals, the left (L) and right (R) signals, are derived from, for examaple, a two-track record and contain direction information. The L and R signals are applied to a matrix quadraphonic decoder 102 of, for example, an SQ system of CBS. Four output sgnals $L'_F$ (left front), $R'_F$ (right front), $R'_B$ (right back) and $L'_B$ (left back) are derived from decoder 102. These four signals are operated on by the circuitry of this invention in dotted box 114 to produce four enhanced signals $L''_F$ (left front), $R''_F$ (right front), $R''_B$ (right back) and $L''_B$ (left back).

The four speakers 110, 111, 112 and 113 are shown enclosed in a dotted box 115 which represents, for example, a room in which the quadraphonic system is located. Speakers 110, 111, 112 and 113 are the left front, right front, left back and right back speakers, respectively. Thus, the signals $L''_F$ are applied through an amplifier 106 to speaker 110, the $R''_F$ signals are applied through an amplifier 107 to speaker 111, the $L''_B$ signals are applied through an amplifier 109 to speaker 112, and the $R''_B$ signals are applied through an amplifier 108 to speaker 113.

This invention provides the enhanced signals $L''_F$, $R''_F$, $L''_B$ and $R''_B$ by means of a detector 103, a processor 104 and a matrix multiplier 105. The $L'_F$, $R'_F$, $R'_B$ and $L'_B$ signals from decoder 102 are applied to both detector 103 and matrix multiplier 105. Detector 103 in response to the $L'_F$, $R'_F$, $R'_B$ and $L'_B$ signals applied thereto provides, by suitable techniques of amplitude comparison, a number of control signals labeled $C\theta$ each activated by the presence of a predominant sound source in a corresponding direction $\theta$. These control signals are applied as input signals to processor 104. Processor 104, by means of circuitry controlling the charging and discharging of capacitors in accordance with the control signals present, adjusts the attack and decay characteristics of these signals to give optimum results. Following adjustment of the attack and decay characteristics, processor 104 limits the signals and combines them in various proportions to produce signals corresponding to the coefficients $b_{ij}$ of matrix B of equation (46) in accordance with equations (46*a*) to (46*p*) for example. These matrix coefficient signals are applied to matrix multiplier 105 as shown in FIG. 1 and the signals $L'_F$, $R'_F$, $R'_B$ and $L'_B$ are also applied to matrix multiplier 105. Matrix multiplier 105 carries out the operation of matrix multiplication of the incoming signals vector *d*, whose components are $L'_F$, $R'_F$, $R'_B$ and $L'_B$, by the matrix M defined by equations (12) and (46) to produce the four audio signals $L''_F$, $R''_F$, $R''_B$ and $L''_B$ which are the components of vector *m* of equation (8). These output signals are substantially identical psychoacoustically to the original signals applied to the matrix encoder used for recording or transmission of the signals L and R which are subsequently applied to matrix decoder 102.

Figure 2:
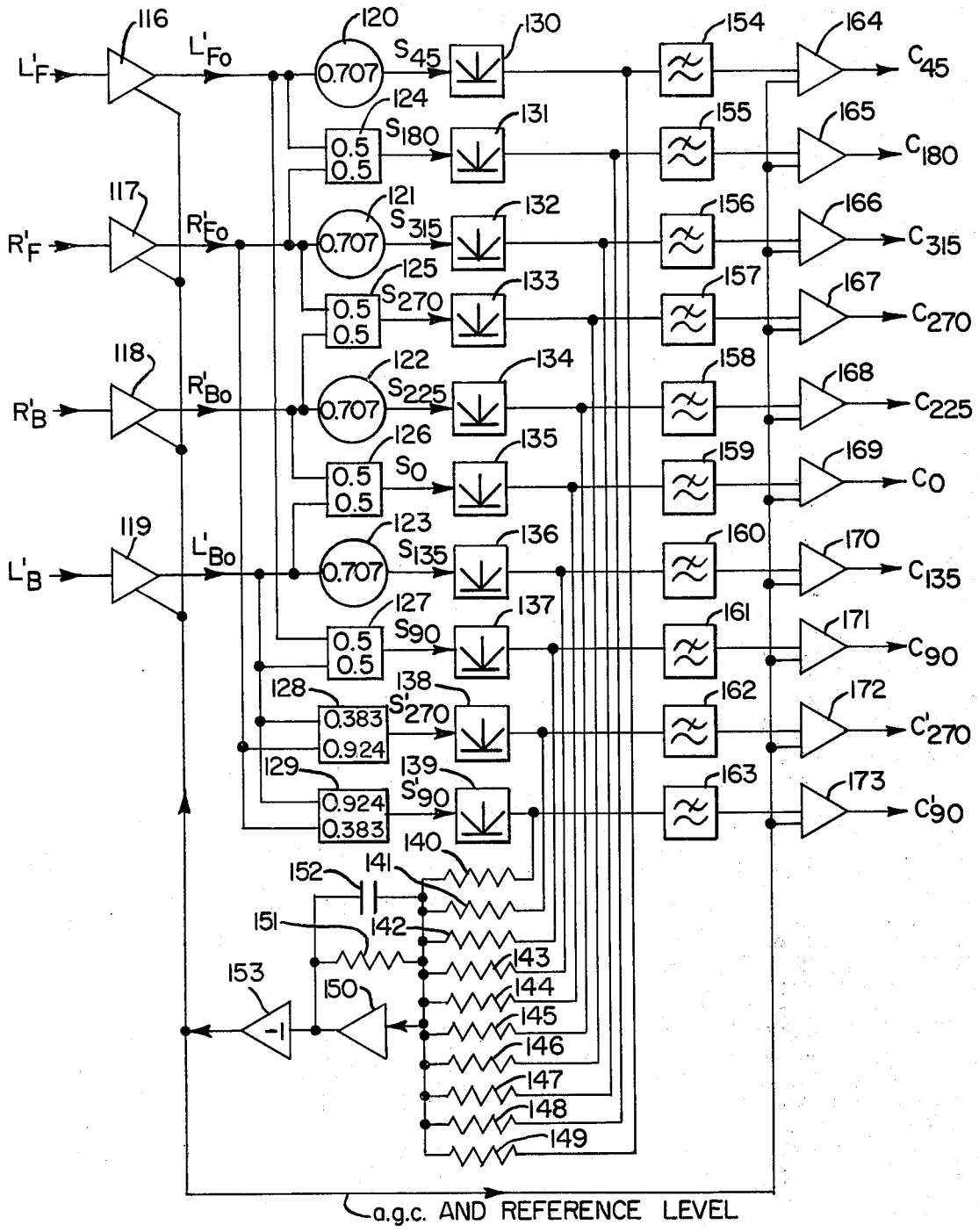
FIG. 2 is a detailed showing of a suitable detector of the invention for application in an SQ quadraphonic sound system.
Figure 3:
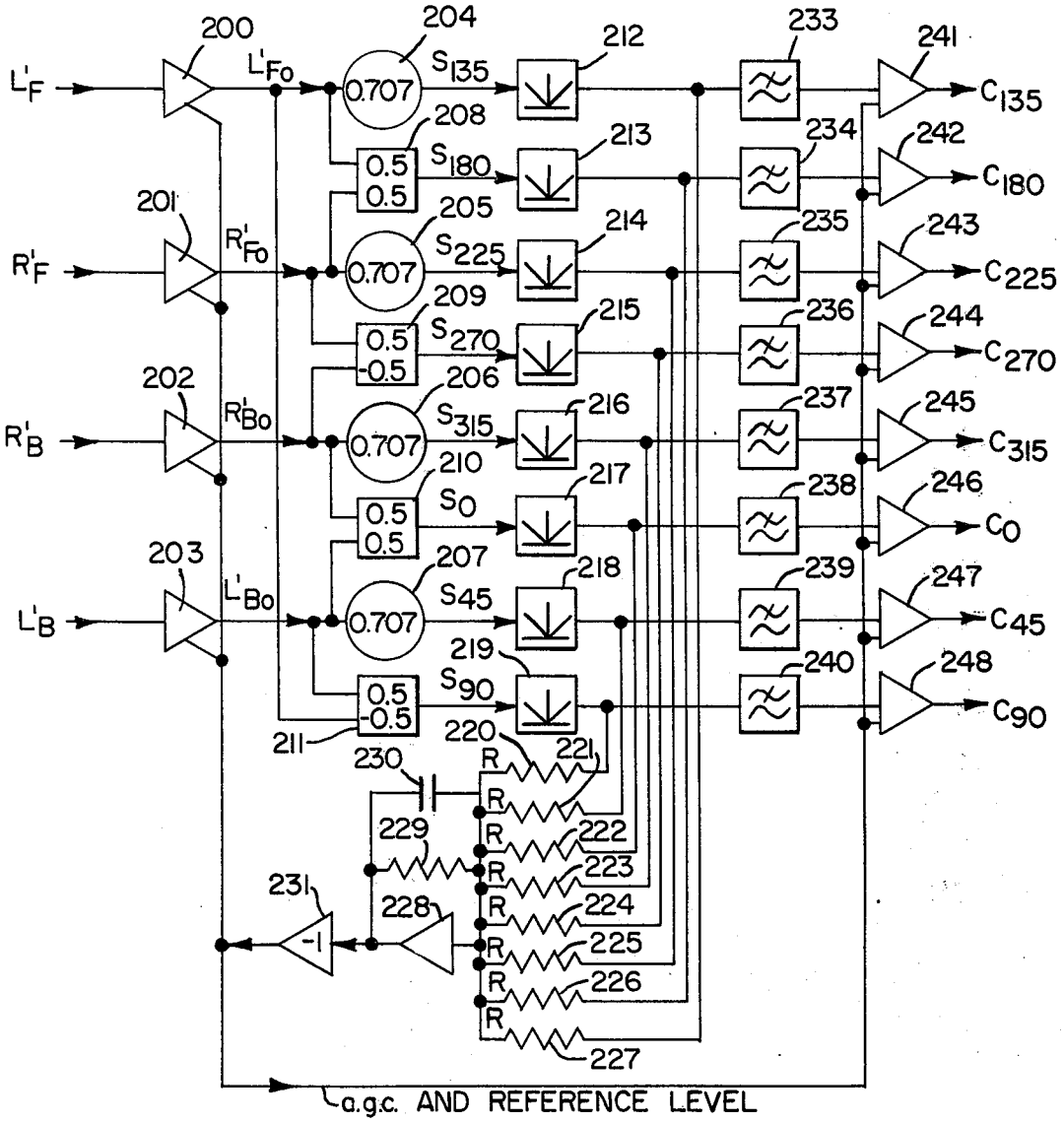
FIG. 3 is a detailed showing of a suitable detector of the invention for application in a QS quadraphonic sound system.
Figure 4:
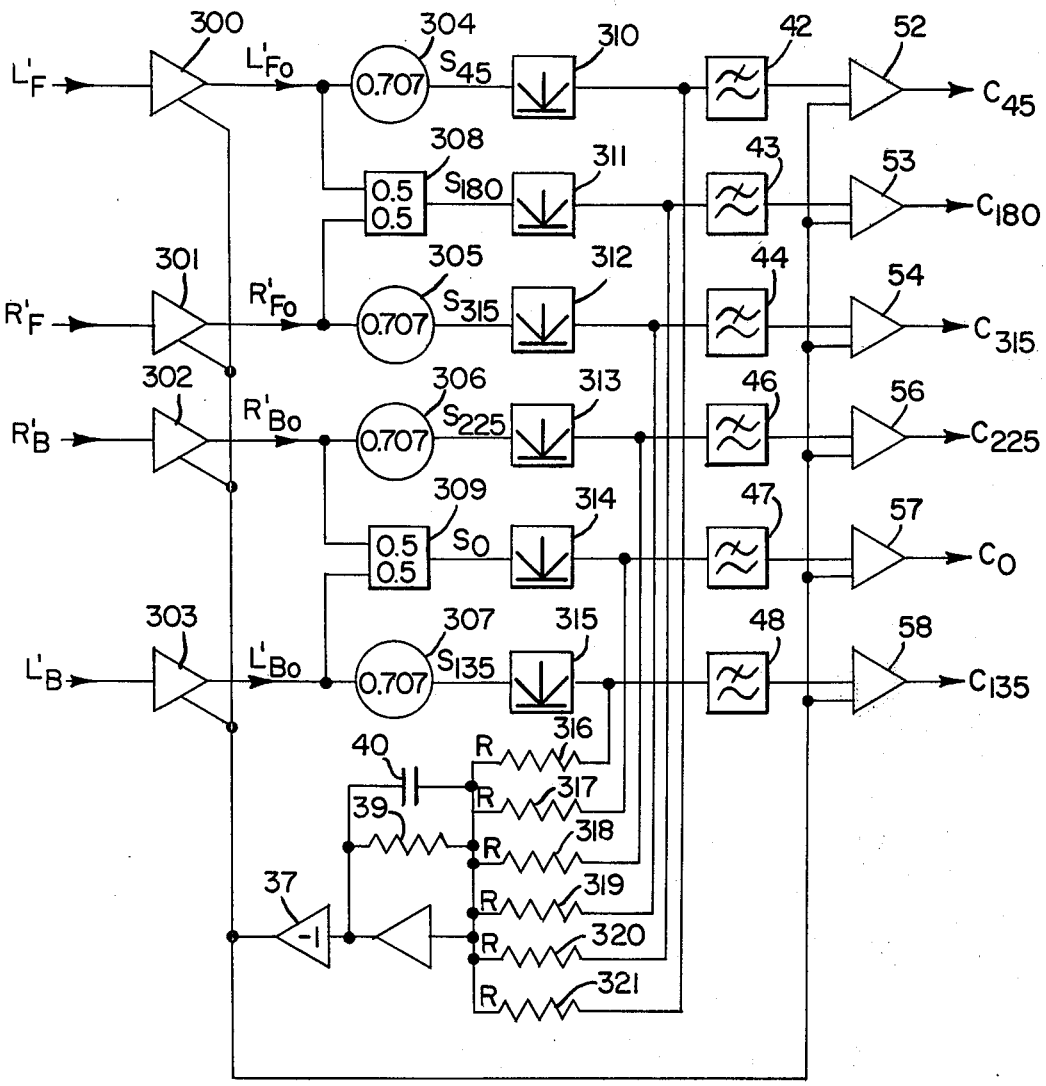
FIG. 4 is a detailed showing of a modification of the detector of FIG. 2.

Referring back to detector 103, detector 103 can provide any number of control signals as desired; however, typically between five and ten such signals are provided. FIGS. 2 and 4 show in detail two alternate embodiments of detector 103 as applied to the SQ system. In FIG. 2, ten control signals are provided and in FIG. 4 only six control signals are provided. FIG. 3 is a detailed showing of detector 7 as applied to a QS system.

In the FIG. 2 embodiment of detector 103, the four signals $L'_F$, $R'_F$, $R'_B$ and $L'_B$ are applied to the four variable gain amplifiers 116, 117, 118 and 119 respectively. Variable gain amplifiers 116, 117, 118 and 119 form part of an automatic gain control system. The outputs of these amplifiers labeled $L'_{Fo}$, $R'_{Fo}$, $R'_{Bo}$ and $L'_{Bo}$ are essentially the same signals as the input signals $L'_F$, $R'_F$, $R'_B$ and $L'_B$ except that they are standardized to a predetermined level by variable gain amplifiers 116, 117, 118 and 119. These output signals from amplifiers 116 through 119 are applied to the attenuators 120, 121, 122 and 123 and to the signal combiners 124, 125, 126, 127, 128 and 129 in the manner shown in FIG. 2. For example, the output signals $L'_{Fo}$ from amplifier 116 are applied to attenuator 120 and combiners 124 and 127; and the signals $R'_{Fo}$ from amplifier 117 are applied to attenuator 121 and combiners 124, 125, 128 and 129. Attenuators 120 through 123 attenuate these signals by the factor indicated and combiners 124 through 129 combine the signals in the proportions indicated to produce the ten signals $S_{45}$, $S_{180}$, $S_{315}$, $S_{270}$, $S_{225}$, $S_o$, $S_{135}$, $S_{90}$, $S'_{270}$ and $S'_{90}$, each of which becomes zero when the predominant signal comes from the direction indicated by the subscript. The two primed signals $S'_{270}$ and $S'_{90}$ are those which are zero for position encoded center left and right sources. These signals also reach a maximum level for some other direction of the source, and the attenuations and combinations of the attenuators and combiners are such that these maxima are all at the same level.

These direction sensitive signals $S_{45}$, $S_{180}$, $S_{315}$, $S_{270}$, $S_{225}$, $S_o$, $S_{135}$, $S_{90}$, $S'_{270}$ and $S'_{90}$ are rectified by the rectifiers 130, 131, 132, 133, 134, 135, 136, 137, 138 and 139 respectively. The transfer characteristics of each of the rectifiers 130 through 139 is indicated diagrammatically on each of the boxes representing the rectifiers. There are no smoothing time constants at the outputs of the rectifiers and the unsmoothed signals from rectifiers 130, 131, 132, 133, 134, 135, 136, 137, 138 and 139 are applied to the resistors 140, 141, 142, 143, 144, 145, 146, 147, 148 and 149 respectively. All of the resistors 140 through 149 are connected to the input of the amplifier 150. Thus, resistors 140 through 149 combine the signals from rectifiers 130 through 139 at the input of amplifier 150. If resistors 143, 144, 145, 147, 148 and 149 have a resistance value R then resistors 140, 141, 142 and 146 have a resistance value 2R. These values of resistance add equal proportions of each of the corner signals and the center front or back signals, and the average center left and center right signals to the input of amplifier 150. The resistor 151 serves as a feedback resistor and its value is chosen to given an output d.c. level equal to a fraction of the maximum d.c. level reached by any rectifier output. The capacitor 152 is a smoothing capacitor. The output from amplifier 150 is applied to a unity gain inverter 153 which inverts the output of amplifier 150 to the correct polarity to drive the gain control inputs of variable gain amplifiers 116 through 119. Thus, the signals from inverter 153 provide a gain control voltage to variable gain amplifiers 116 through 119.

Figure 6:
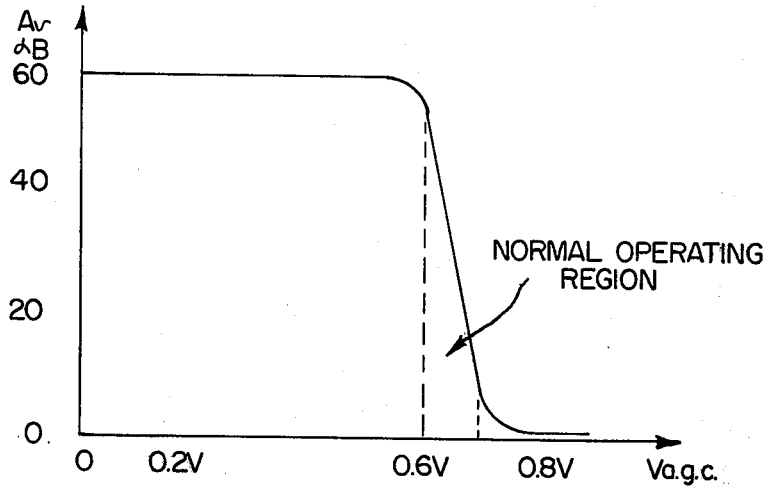
FIG. 6 is an amplifier gain control characteristic diagram.

Amplifiers 116 through 119 may typically have a gain control characteristic similar to that shown in FIG. 6. The characteristic curve shown in FIG. 6 has a fairly sharp knee and a rather narrow operating range of control voltage. The control is essentially logarithmic so that the amplifier gain falls by, for example, 1db per mV above the knee voltage. The logarithmic characteristic aids the overall stability of the automatic gain control system and its sharpness ensures that the normalized signals stay close to the predetermined level over a wide range of input levels.

In addition to providing a drive voltage to amplifiers 116 through 119, inverter 153 provides a reference level voltage to the comparator amplifiers 164 through 173. Comparator amplifiers 164 through 173 each have two inputs and one of the two inputs of all the comparators 164 through 173 is coupled to the output of inverter 153. The second input of each of the comparators 164 through 173 is connected to output of a different one of the smoothing filters 154 through 163 as shown in FIG. 2. Smoothing filters 154 through 173 are connected between rectifiers 130 through 139 and comparators 164 through 173 in such a manner that the output of each rectifier after being smoothed by its associated smoothing filter is applied as the second input to the associated comparator. That is, the output of rectifier 134 is smoothed by filter 154 and then applied to the second input of comparator amplifier 164, the output of rectifier 131 is smoothed by filter 155 and then applied as the second input to comparator 165, etc. The output of each smoothing filter 154 through 163 is compared by its associated comparator 164 through 173 to the reference level voltage provided by inverter 153. The comparator amplifier 164 through 173 provides an output only if the input from the associated smoothing filter 154 through 163 is less than the reference from inverter 153. The reference level is so chosen that only those signals applied to comparators 164 through 173 that fall within a defined range of the specified direction fall below the reference level since each direction signal applied to the comparators 164 through 173 may have minima other than those in the specified direction.

The output signals from comparators 164, 165, 166, 167, 168, 169, 170, 171, 172 and 173 are labeled $C_{45}$, $C_{180}$, $C_{315}$, $C_{270}$, $C_{225}$, $C_o$, $C_{135}$, $C_{90}$, $C'_{270}$ and $C'_{90}$. These signals are the raw directional control signals that are applied to processor 104.

Figure 5:
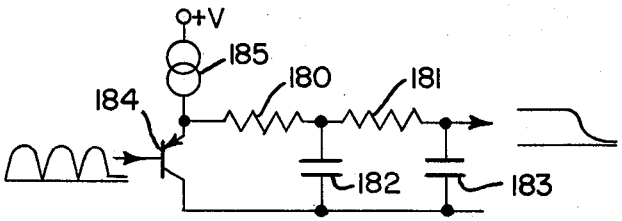
FIG. 5 is a detailed showing of a preferred interface between a rectifier output and a typical smoothing filter of the detector.

FIG. 5 shows a typical interface between a smoothing filter and its associated rectifier of FIG. 2 and shows a typical filter that can be utilized for the smoothing filters 154 through 163. FIG. 5 shows a two stage ladder filter comprising the resistors 180 and 181 and the capacitors 182 and 183. The filter is designed to have as fast a transient response as possible with a satisfactory attenuation of ripple at the lowest signal frequencies. Since the intention is to detect the absence of a signal at the detection point, a PNP transistor 184 is utilized to pull down the input whenever the signal applied to the base of transistor 184 from the associated rectifier, normally a full-wave rectified audio signal with a non-zero average level, falls to zero. Current is supplied to the emitter of transistor 184 by means of the current source 185. Current source 185 is of such a value that faithful reproduction of the positive peaks of the input signal at the emitter is ensured. Thus, the response to a sudden cessation of the signal is made as rapid as possible.

FIG. 3 is a detailed showing of a possible configuration of detector 103 when the invention is utilized in a QS system. As is the case in FIG. 2, the circuitry of FIG. 3 includes the four variable gain amplifiers 200 through 203, the attenuators 204 through 207 and the signal combiners 208 through 211. Attenuators 204 through 207 and combiners 208 through 211 are connected to the outputs of variable gain amplifiers 200 through 203 in the manner indicated in FIG. 3. The balance of the circuitry and the circuit connections are identical in character to the corresponding circuitry of FIG. 2 except that the number of separate individual elements provided is smaller since only eight control signals are provided in FIG. 3 as compared to the ten control signals provided with the circuitry of FIG. 2. Thus, the circuitry of FIG. 3 in addition to the attenuators, the combiners and the variable gain amplifiers includes the eight full-wave rectifiers 212 through 219, the eight associated smoothing filters 233 though 240, the eight associated comparator amplifiers 241 through 248, the eight resistors 220 through 227 in the gain control circuitry, the summing amplifier 228, the feedback resistor 229, the smoothing capacitor 230 and the unity gain inverter 231. The resistors 220 through 227, summing amplifier 228 and unity gain inverter 231 of course provide the gain control and reference level voltage to variable gain amplifiers 200 through 203 and to comparators 241 through 248 respectively. Unlike the corresponding resistors in FIG. 2, resistors 220 through 227 all have the same resistance value in FIG. 3 since there are no alternative center left and right signals. In addition to this difference in the resistors, the corresponding signals from most of the attenuators and combiners in FIG. 3 when compared with these elements in FIG. 2 are zero at different directions since the encoding and decoding equations for the QS system are different than the encoding and decoding equation of the SQ system. The outputs from attenuators 204 through 207 and combiners 208 through 211 starting at attenuator 204 and proceeding downward in FIG. 3 are $S_{125}$, $S_{180}$, $S_{225}$, $S_{270}$, $S_{315}$, $S_o$, $S_{45}$, and $S_{90}$ and the control signals from comparator amplifiers 241, 242, 243, 244, 245, 246, 247 and 248 are $C_{135}$, $C_{180}$, $C_{225}$, $C_{270}$, $C_{315}$, $C_o$, $C_{45}$ and $C_{90}$ respectively.

FIG. 4 shows a simplified implementation of the detector when the invention is used in the SQ system. In other words, FIG. 4 is a simplified version of the circuitry of FIG. 2. In FIG. 2 ten control signals are provided whereas in FIG. 4 only six control signals are provided, the control signals for center left and right being omitted. This, of course, results in cost savings in the detector and in the following circuitry, but these savings in cost may be accompanied with a loss in quality of the ultimate signals to the speakers. Except for the reduction in the number of control signals provided, the circuitry of FIG. 4 is identical to the circuitry of FIG. 2. By a direct comparison with FIG. 2, it will be obvious that the comparator amplifiers, smoothing filters, rectifiers and combiners that provide the $C_{270}$, $C_{90}$, $C'_{90}$ and $C'_{270}$ (center left and right and alternative center left and right) signals in FIG. 2 and resistors 140, 141, 142 and 146 of FIG. 2 are omitted in the circuitry of FIG. 4; otherwise, the circuits are identical and the operation of the identical circuitry is the same. Therefore, the numerals used in FIG. 4 are identical for corresponding elements to the numerals used in FIG. 2. A detailed discussion of the circuitry of FIG. 4 would merely be a repetition of that given above for FIG. 2 and therefore such a detailed description of FIG. 4 should not be necessary. It should be noted, however, that since the center left and right and alternate center left and right signals are not provided in FIG. 4, the resistors of FIG. 2 eliminated in FIG. 4 are resistors 140, 141, 142 and 146 which have a resistance value twice that of the remaining resistors.

The detailed circuitry shown in FIGS. 2, 3, and 4 for detector 103 are given as an example of preferred circuit arrangements for detector 103, however, it will be obvious to those skilled in the art that various modifications and changes can be made to these circuits. However, the fact that these circuits provide a reference voltage that is substantially independent of the source direction is of particular significance and represents an improvement over systems which define the reference voltage only from the rectified levels of the four input signals without combining these signals. For example, the reference level signal obtained with the ten directional control signals system of FIG. 2 varies by less than one-half percent with source direction; whereas in those systems that define the reference level voltage only from the rectified levels of the four signals, the reference voltage may vary as much as fourteen percent with source direction. Furthermore, the comparison of the rectified signals with the reference voltage as derived in FIGS. 2, 3 and 4 permits the detection efficiency to be virtually independent of the signal level. This insures that the enhancement of the directionality in the signals remains effective over a wider range of input signal level than has been achieved in other systems.

Figure 7:
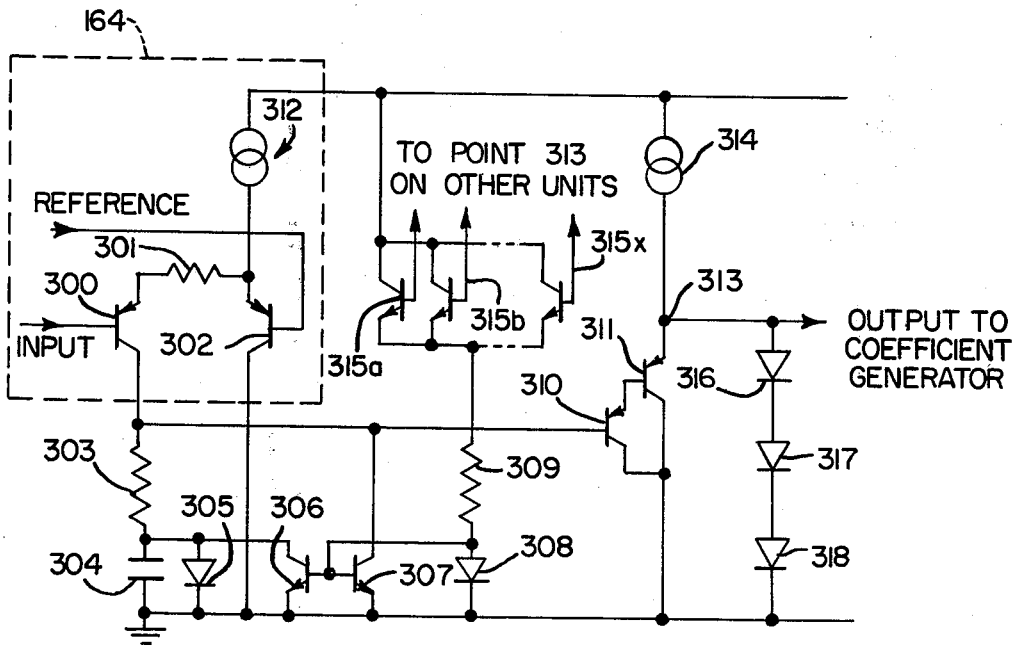
FIG. 7 shows a typical comparator circuit utilized in the processor of this invention.

FIG. 7 shows a typical circuit that may be used for the comparator amplifiers of FIGS. 2, 3 and 4 and typical circuitry for a portion of processor 104. Thus in FIG. 7 the comparator amplifier shown in detail may be comparator amplifier 164 of FIGS. 2 and 4. Of course, the circuitry of all the other comparator amplifiers in FIGS. 2, 3 and 4 would be identical to the circuitry shown in FIG. 7. Further, other known suitable comparator circuts could be used for the comparator amplifiers of these figures.

Referring now specifically to FIG. 7, comparator amplifier 164 comprises a first transistor 300 and second transistor 302. The emitter of transistor 300 is coupled to the emitter of transistor 302 through a resistor 301. Input signals from the associated rectifier, which in this case would be rectifier 154 of either FIG. 2 or 4 since it is assumed that the comparator shown in detail is comparator 164, are applied to the base of transistor 300. The reference level voltage is applied to the base of transistor 302. A current source 312 is coupled to the common point of the emitter of transistor 302 and resistor 301 and the collector of transistor 302 is connected to ground.

The balance of the circuitry in FIG. 7 is a part of the total circuitry of processor 104. As shown in FIG. 7, this circuitry includes a pair of Darlington connected transistors 310 and 311, a second pair of base connected transistors 306 and 307 and a plurality of transistors 315a to 315x. The number of transistors 315 that are provided is one less than the number of comparator amplifiers provided. Thus, for the ten signal system exemplified by FIG. 2, nine such 315 transistors would be provided in each stage. In the ten signal case, ten stages identical to the circuitry of FIG. 7 would be provided.

The three series connected diodes 317, 318 and 319 are connected between the collector of transistor 311 and ground, and a current source 314 is coupled to the collector of transistor 311. Any output signals present at the collector of transistor 311 are applied to a coefficient generator as will be apparent later herein.

The 315 transistors are all connected in parallel and a diode 308 and a resistor 307 are connected in series between ground and the emitters of the 315 transistors. The base of each of the 315 transistors is connected to a point 313 of a different one of the other stages. For example, the base of transistor 315a could be connected to the point 313 of the stage of processor 104 associated with comparator 165 of FIG. 2 and the transistor 315b could be connected to the point 313 of the stage of processor 104 associated with comparator 166.

The emitters of both transistors 307 and 306 are connected to ground and their base electrodes are directly connected together and to the common point of the series connection of resistor 309 and diode 308. The collector of transistor 307 is coupled to the base of Darlington transistor 310 and the common point of a resistor 303 and the collector of comparator transistor 300. Resistor 303 is connected in series with a capacitor 304 between ground and the collector of comparator transistor 300. A diode 305 is connected across capacitor 304 and the collector of transistor 306 is connected to the common point of diode 305, capacitor 304 and resistor 303.

As was mentioned above and is shown in FIG. 7, the signals from the associated rectifiers are applied to the base of comparator transistor 300 and the reference level voltage is applied to the base of comparator transistor 302. Under normal conditions the current provided by current source 312 flows through the collector of transistor 307; however, if the input signal voltage applied to the base of comparator transistor 300 falls below the reference level voltage applied to the base of comparator transistor 302, part of this current flow is diverted through the collector of comparator transistor 300.

Resistor 301 is chosen to have a value which will ensure that all the current is transferred to transistor 67 substantially before the output from the associated rectifier reaches zero. This characteristic assists the detection of predominant signals in the presence of significant signals from other directions.

When the current from current source 312 is diverted to transistor 300, a voltage is generated across resistor 303, and capacitor 304 commences to charge. At the same time the voltage at the emitter of transistor 311 of the Darlington pair rises immediately to a maximum value determined by the diodes 316, 317 and 318. The PNP Darlington pair of transistors 311 and 312 act as a buffer and level shifter. If the signal to the base of comparator transistor 300 is of short duration, capacitor 304 will not retain a significant charge and the output at the emitter of transistor 311 will drop quickly. On the other hand if the signal to the base of comparator transistor 300 is of a longer duration, capacitor 304 will charge to a level limited by diode 305 and upon the cessation of the input signal to comparator transistor 300 capacitor 304 will discharge slowly, thereby causing the output voltage at the emitter of transistor 311 to decay slowly. If, in the meantime, another signal from a different direction is present one of the other stages will be active and the output voltage from that stage will be applied to the base of the 315 transistor connected to point 313 of that stage thereby causing current to flow in resistor 309. This current flow in resistor 309 causes a similar current flow in transistors 306 and 307 since this current flow in resistor 309 provides a forward bias on the bases of transistors 306 and 307. This forward bias is limited by diode 308. This current flow in transistors 306 and 307 immediately pulls down the base voltage on transistor 310 and commences to discharge capacitor 304 fairly rapidly. When the signal in this other stage ceases, the current flow in transistors 306 and 307 ceases. If the current flow in transistors 306 and 307 is of such short duration that capacitor 304 has not discharged completely, the voltage at the base of transistor 310 will rise again at the cessation of this short duration current flow in transistors 306 and 307. This feature enables the directional control to be temporarily snatched by a brief signal from a different direction to the predominant signal.

Figure 8:
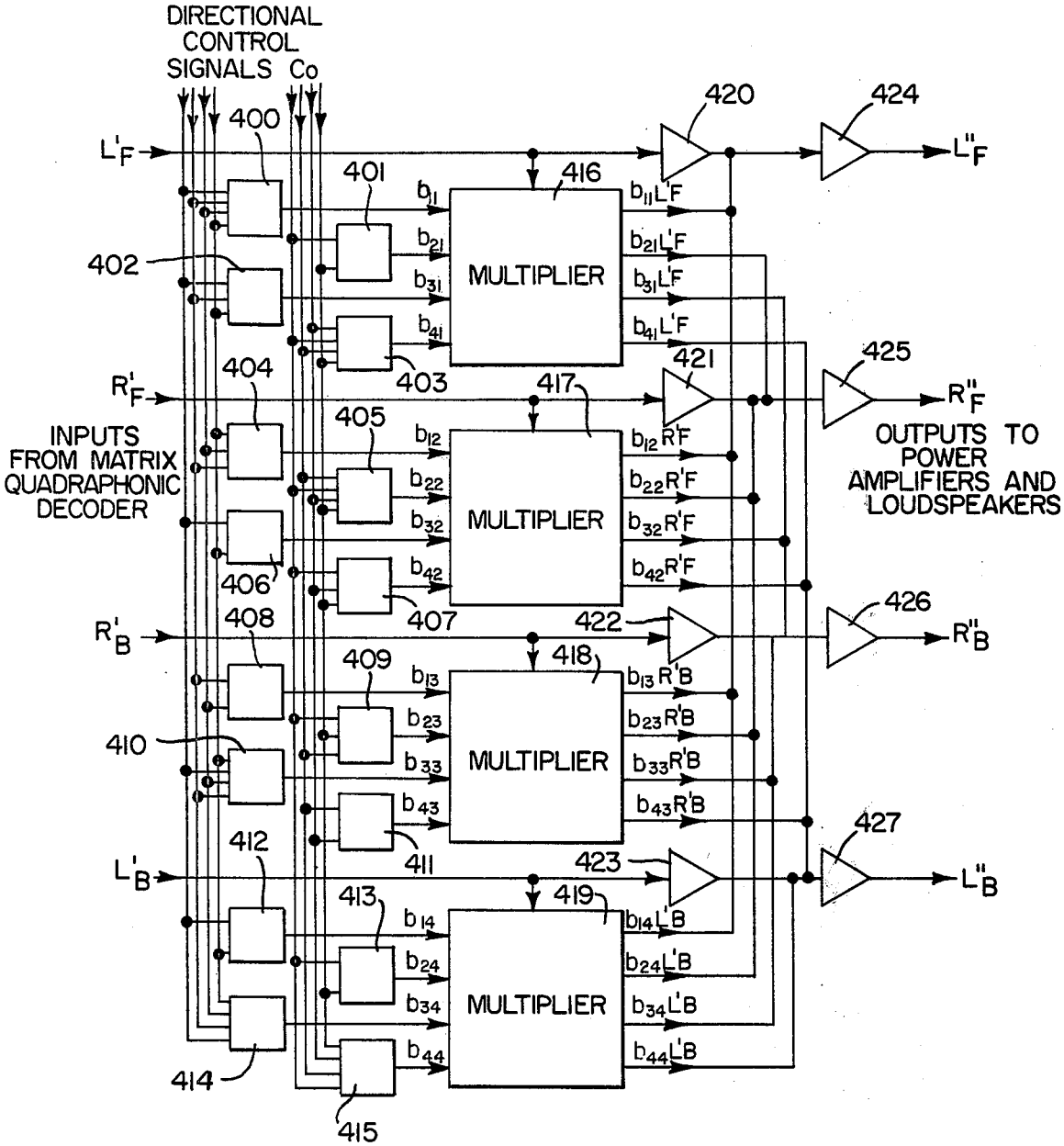
FIG. 8 is a detailed showing of the coefficient generator and matrix multiplier sections of the invention.

FIG. 8 shows a typical configuration of the coefficient generator which provides the matrix coefficient signals to matrix multiplier 105 and a typical configuration of matrix multiplier 105. The signals applied to the coefficient generator are, of course, provided from the output of transistors 311 of the stages such as the stage shown in FIG. 7. In FIG. 7 the diodes 316, 317 and 318 are part of the interface to the coefficient generator.

In FIG. 8, only eight directional control signals are shown. Thus, the coefficient generator of FIG. 8 could be the coefficient generator associated with the detector of FIG. 3 or, as will be apparent later, this eight directional control signal could come from the ten signal detector of FIG. 2 with the center left and right signals combined. The important fact to be kept in mind with respect to FIG. 8 is that the configuration shown is a typical one for use with eight directional control signals.

The coefficient generator of FIG. 8 comprises the sixteen signal combiners 400 through 415. The directional control signals from the comparators of detector 103 are applied to combiners 400 through 415 of the coefficient generator through their associated circuits such as the circuit shown in FIG. 7. The directional control signals may be applied to the combiners 400 through 415 in the manner shown in FIG. 8. However, as will be apparent later, other combinations of these directional control signals can be applied to combiners 400 through 415. The particular combination of signals applied to a particular combiner of the coefficient generator will depend upon the design of the combiner and the system in which the invention is utilized. In any event, the design of a given one of the combiners 400 through 415 and the directional control signals applied to it must be such that the coefficient generator provides the appropriate coefficient signals to the matrix multiplier.

In FIG. 8, matrix multiplier 105 is shown as comprising the four multiplier blocks 416, 417, 418 and 419. The matrix coefficient output signals from four combiners of the coefficient generator are applied to each of the multiplier blocks 416 through 419. For example, the output signals from combiners 400, 402, 401 and 403 are applied to multiplier block 416 and the output signals from combiners 412, 414, 413 and 415 are applied to multiplier 419. In addition to the matrix coefficient signals from the four associated combiners, the signals $L'_F$, $R'_F$, $R'_B$ and $L'_B$ from matrix quadraphonic decoder 102 of FIG. 1 are applied to multiplier blocks 416, 417, 418 and 419 respectively. Each of the multipliers 416 through 419 multiplies the decoded input signals applied to it from matrix quadraphonic decoder 102 by each of the four coefficient signals applied to that multiplier. Thus, multiplier 416 multiplies the $L'_F$ signal by each of the coefficient signals received from combiners 400, 401, 402 and 404 and multiplier 417 multiplies the $R'_F$ signals by each of the coefficient signals from combiners 404, 405, 406 and 407, etc. This multiplication process provides four outputs from each of the multipliers 416 through 419 a shown in FIG. 8.

In addition to the multiplier blocks 416 through 419, the matrix multiplier includes the four current amplifiers 420, 421, 422 and 423 and the current to voltage converters 424, 425, 426 and 427. The signals $L'_F$, $R'_F$, $R'_B$ and $L'_B$ are applied to the inputs of current amplifiers 420, 421, 422 and 423 and the outputs of current amplifiers 420, 421, 422 and 423 are coupled to the inputs of current to voltage converters 424, 425, 426 and 427 respectively. In addition to the output from the associated current amplifier, one of the four outputs from each of the four multiplier blocks 416 through 419 is applied to the input of one of the current to voltage converters 424 through 427. For example, the output of current amplifier 420, the $b_{11}L'_F$ output of multiplier 416, the $b_{12}R'_F$ output of multiplier 417, the $b_{13}R'_B$ output of multiplier 418 and the $b_{14}L'_B$ output of multiplier 419 are all applied to the input of current to voltage converter 424. In response to the five inputs to each of the current to voltage converters 424 through 427, these converters produce the four signals required by equation (8). In FIG. 8 sixteen combiners are shown; in application to a particular system, the actual number may be less, the outputs being applied to more than one coefficient input of the matrix multiplier.

Figure 9:
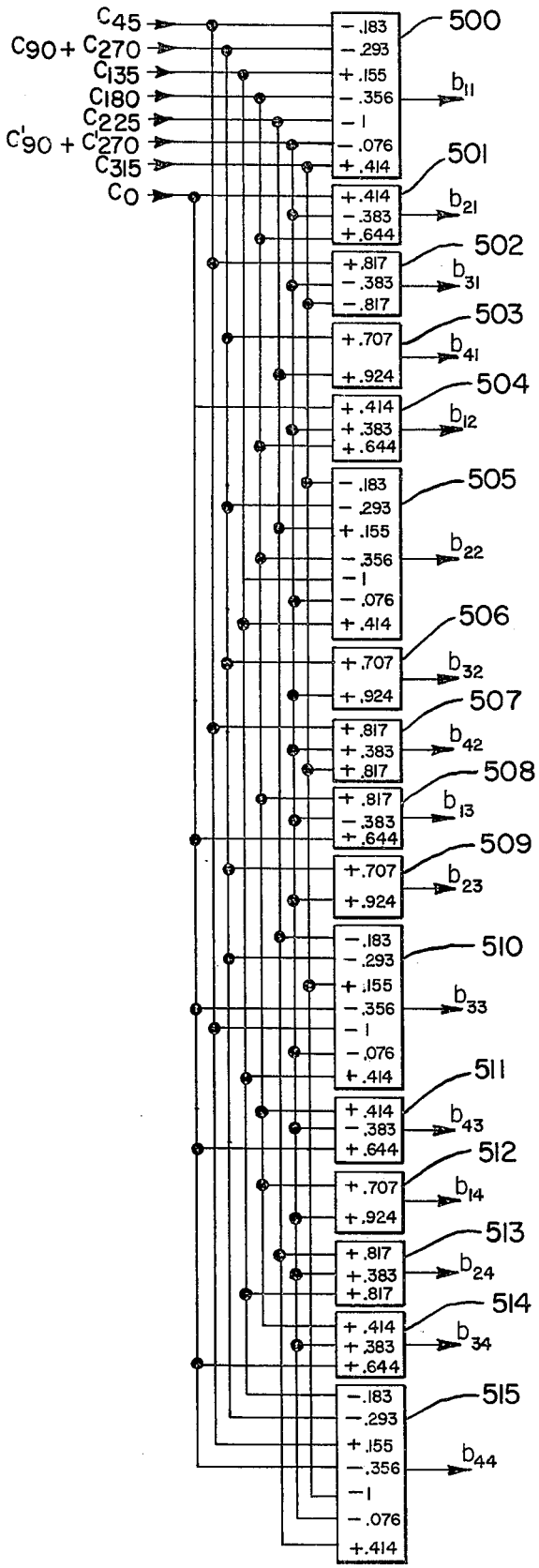
FIG. 9 is a detailed showing of an example of a coefficient generator or the invention used in the ten signal system of FIG. 2.

FIG. 9 shows in detail a typical coefficient generator for the ten directional control signal detector of FIG. 2. As is the case in FIG. 8, the coefficient generator of FIG. 9 includes sixteen combiners. Note, however, that only eight instead of ten directional signals are applied to the combiners 500 through 515. The ten directional control signals are reduced to eight by combining the center left and center right pairs. The particular combinations of the directional control signals by combiners 500 through 515 are indicated for each of the combiners in FIG. 9. The outputs from combiners 500 through 515 are labeled identically to the outputs from combiners 400 through 415 with the second numeral of the subscript indicating to which multiplier that signal is applied and the first numeral of the subscript to which input of that multiplier. Thus, coefficient output $b_{11}$ applied to the first input of multiplier 416 of FIG. 8, $b_{21}$ is applied to the second input of multiplier 416, etc.

Figure 10:
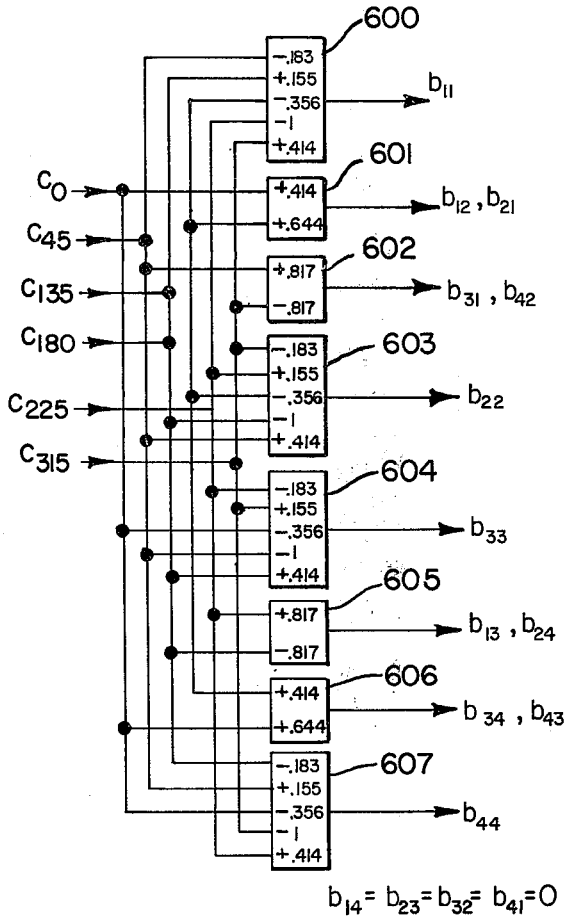
FIG. 10 is a detailed showing of an example of a coefficient generator of the invention used in the six signal system of FIG. 4.

FIG. 10 shows in detail a typical coefficient generator for the six directional control signal system of FIG. 4. The six directional control signal system requires only eight distinct outputs from the coefficient generator and these outputs are provided by the eight signal combiners 600 through 607. Typical proportions of the combinations of the signals is indicated in each of the combiners 600 through 607. The outputs of combiners 600 through 607 are again designated by the letter $b$ with the subscript indicating the multiplier and multiplier input to which that signal is applied. In FIG. 10 arrangement the output of each of the combiners 601, 602, 605 and 606 is connected to two multipliers of the matrix multiplier. This provides for a total of only twelve coefficient outputs rather than the sixteen outputs for the sixteen inputs of the matrix multiplier. The other four outputs which are the outputs $b_{14}$, $b_{23}$, $b_{32}$, and $b_{41}$ are identically zero, therefore these outputs can be omitted. The fact that these signals are zero is indicated in FIG. 10. Thus, the sixteen signals are accounted for. With respect to providing a coefficient signal to more than one input of the matrix multiplier from a single combiner, the number of combiners provided in FIG. 9 could also be reduced.

Referring back to FIG. 9, it will be noted that combiners 503, 506, 509 and 512 are identical and have the same directional control signal inputs. Therefore, all but one of these combiners could be eliminated with the output of the remaining one of the four being connected to four inputs of the matrix multiplier. For example, if combiners 506, 509 and 512 were eliminated, combiner 503 would provide the $b_{41}$, $b_{32}$, $b_{23}$ and $b_{14}$ inputs to the matrix multiplier.

Figure 11:
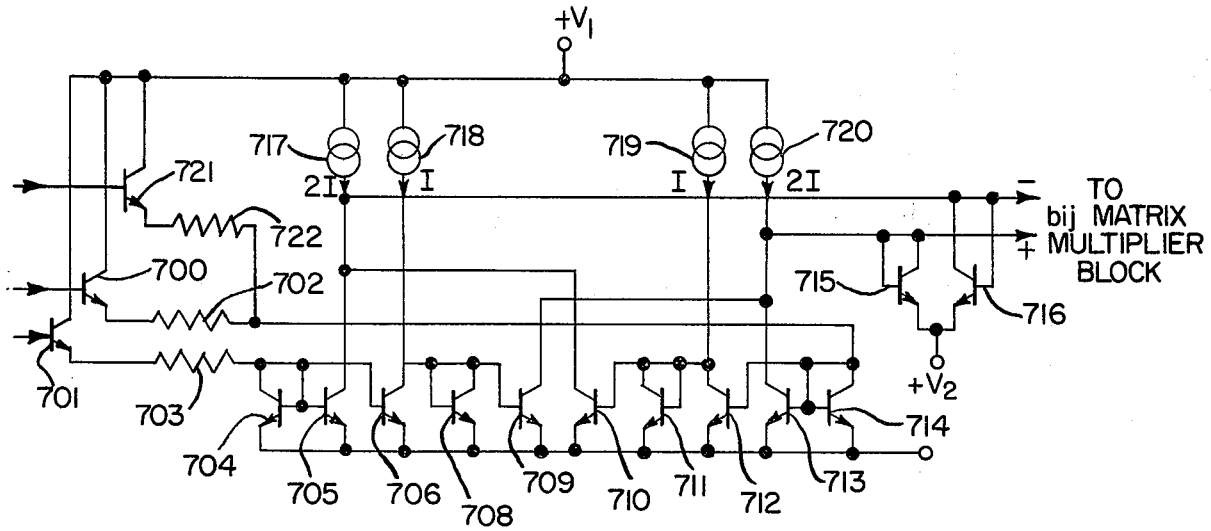
FIG. 11 is a detailed showing of a signal combiner that can be used in this invention.

The combiners of FIGS. 8, 9 and 10 could be built using operational amplifiers or a simple alternative circuit such as the circuit shown in FIG. 11 can be utilized. Referring to FIG. 11, in this circuit which is designed to interface with the circuit of FIG. 7 the input signals from two or more directional control outputs are applied to the bases of the transistors 700 and 701 and to the bases of as many additional transistors such as transistors 700 and 701 as are required. The number of transistors such as transistors 700 and 701 required for a given combiner depends of course upon the number of different combinations that are to be made in a given combiner. The collectors of transistors 700 and 701 are connected to a voltage source $V_1$ and the emitters of transistors 700 and 701 are connected to the input resistors 702 and 703 respectively. Resistor 703 is coupled to the collector and base of the transistor 704 which is diode connected to the base of the transistor 705, the base of which is connected to the base of transistor 704, and to the base of the transistor 706. The emitter of each of the transistors 704, 705 and 706 is connected to a common point. A current source 717 having a value 2I is coupled to the collector of transistor 705 and the current source 718 having a value I is coupled to the collector of transistor 706. A diode connected transistor 708 with its base connected to its collector is coupled to the collector of transistor 706 and the base of the transistor 709 is also coupled to the collector of transistor 706.

A second set of transistors associated with input resistor 702 consisting of the transistors 710, 711, 712, 713, 714 are provided. Transistors 710, 711, 712, 713 and 714 correspond directly to transistors 709, 708, 706, 705 and 704 respectively, and are interconnected in the same fashion as transistors 704 through 709 except, of course, that resistor 702 is associated with the transistors 710 through 714 whereas input resistor 703 is associated with transistors 704 through 709. In addition, the current sources 719 and 720 are associated with transistors 710 through 714 in the same manner that current sources 717 and 718 are associated with transistors 704 through 709. Thus, the circuit of FIG. 11 actually comprises two circuits that are structurally identical with the elements interconnected in an identical fashion. If additional inputs such as the inputs to the bases of transistors 700 and 701 are required, then additional transistors and resistors such as transistor 721 and resistor 722 would be provided.

In addition to the circuitry thus far described, the circuit of FIG. 11 includes the transistors 715 and 716. The emitters of transistors 715 and 716 are both connected to a voltage source $+V_2$. Transistors 715 and 716 diode both diodes connected since the base of each transistor is connected to its collector. The collector of transistor 709 is coupled to the base collector connection of transistor 715 and the output from this portion of the circuit is taken at this point. Similarly, the collector of transistor 710 is coupled to the base-collector connection of transistor 716 and the output of this part of the circuitry is taken at this point. The coefficient outputs are derived in a differential form to allow the use of a doubly balanced matrix multiplier. The output associated with transistor 715, labeled +, and the output associated with transistor 716, labeled −, form one such differential pair. The designation of the signals refers to the sense of variation of these two outputs.

The resistance value of resistor 703 is chosen such that the current flowing in transistor 705 is $b_{ij}$I where $b_{ij}$ is the appropriate value of the coefficient required corresponding to the particular direction signal, and I is the current flowing in current source 718. The current flow in the collectors of transistors 705 and 706 is equal if they are matched, and therefore, the net current flow in diode connected transistor 708 is $(1-b_{ij})$I, and this current is mirrored in the collector of transistor 709. Similarly, the resistance value of resistor 702 is chosen such that the current flowing in transistor 713 is $b_{ij}'$, where $b_{ij}'$ is the value of $b_{ij}$ for that source direction, and I is the current flowing in current source 719. The current flow in transistors 713 and 712 is equal if they are matched and, therefore, the net current flowing in diode connected transistor 711 is $(1-b_{ij}')$I, and this current is mirrored in the collector of transistor 710. Under these conditions the net current flowing in transistor 715 is $2I-b_{ij}I-(1-b_{ij}')I$, and flowing in transistor 716 is $(1-b_{ij}'+b_{ij})I$. The total current on the two transistors 715 and 716 is always $2I$. The voltages generated across transistors 715 and 716 are proportional to the logarithm of the currents, and are suitable for driving the matrix multiplier element shown in FIG. 12.

Figure 12:
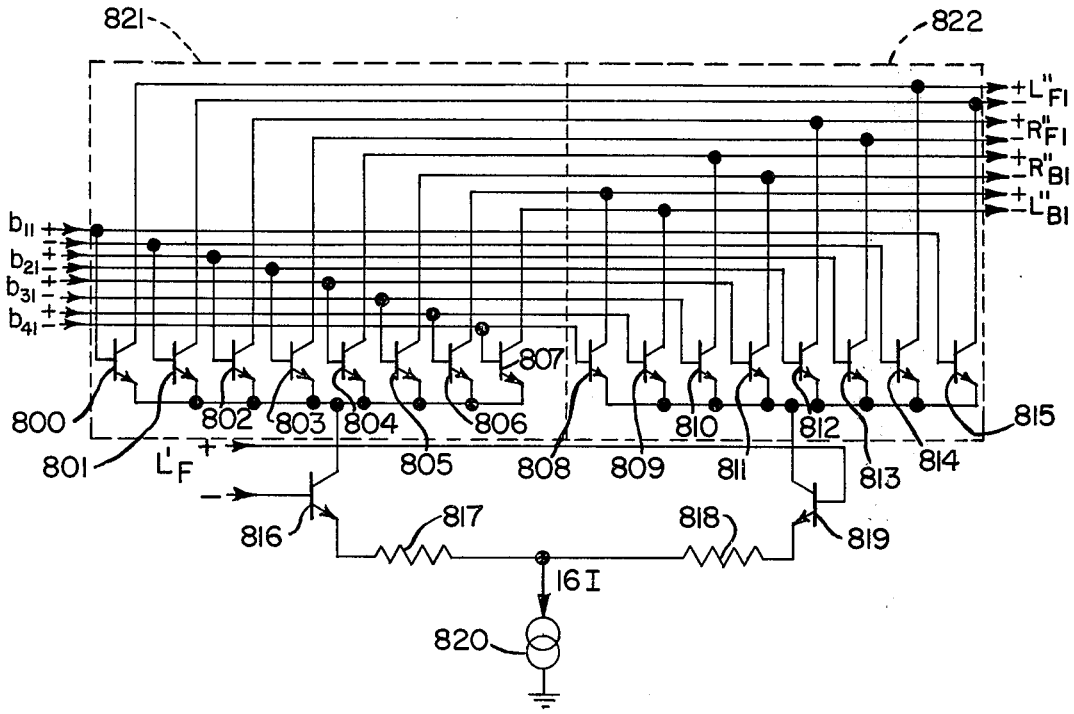
FIG. 12 is a detailed showing of a possible circuit configuration of one of the matrix multiplier blocks of FIG. 8.

FIG. 12 shows in detail a circuit configuration that can be used for each of the composite multiplier blocks 416, 417, 418 and 419 of FIG. 8. This circuit includes a first set 821 of eight matched transistors (the transistors 800 through 807) and a second set 822 of eight matched transistors (the transistors 808 through 815). The base of each of the transistors 800 through 807 is connected to a different one of the eight inputs $b_{11}\pm$, $b_{21}\pm$, $b_{31}\pm$, and $b_{41}\pm$, and the base of each of the transistors 808 through 815 is also connected to a different one of these eight inputs. The emitters of the transistors 800 through 807 are all connected to the collector of the transistor 816, and the emitters of transistors 808 through 815 are all connected to the collector of the transistor 819. The emitter of transistor 816 is coupled to a current source 820 through a resistor 817 and the emitter of transistor 819 is coupled to a current source 820 through the resistor 818. Current source 820 has a current value of 16I. The positive $L'_F$ signals from matrix quadraphonic decoder 102 of FIG. 1 are applied to the base of transistor 819, and the negative $L'_F$ signals from matrix quadraphonic decoder 102 are applied to the base of transistor 816.

Eight outputs, the outputs $\pm L''_{F1}$, $\pm R''_{F1}$, $\pm R''_{B1}$ and $\pm L''_{B1}$ are provided from the circuit of FIG. 12. The collector of each of the transistors 800 through 807 is connected to a different one of these outputs, and the collector of each of the transistors 808 through 815 is also connected to a different one of these outputs. For example, the collector of transistor 800 and the collector of transistor 814 are connected to the positive $L''_{F1}$ output, the collector of transistor 801 and the collector of transistor 815 are connected to the negative $L''_{F1}$ output and the collector of transistor 803 and the collector of transistor 812 are connected to the $\pm R''_{F1}$ output. Thus, a collector of one transistor of set 821 and the collector of one transistor of set 822 are both connected to the same output. Note however that the base of each such pair of transistors is connected to a different polarity of the input. For example, the collector of transistor 800 and the collector of transistor 814 are connected to the $+L''_{F1}$ output, but the base of transistor 800 is connected to the $+b_{11}$ input and the base of transistor 814 is connected to the $-b_{11}$ input.

The current 16I from current source 820 divides equally between transistors 816 and 819 and the other two sets 821 and 822 of matched transistors. In sets 821 and 822 any pair of transistors always carries a total current of 2I. A pair of transistors in each of the sets is defined as the two transistors connected to the positive and negative terminals of the same input. For example, transistor 800 and 801 which are connected to $+b_{11}$ and $-b_{11}$ are a pair and transistors 814 and 815 are a pair.

Two transistors of each of the sets 821 and 822 are connected to a pair of transistors such as the pair 715 and 716 of FIG. 11. For example, assume that the $b_{ij}$ output of FIG. 11 is $\pm b_{11}$ then the base of transistor 800 and the base of transistor 815 would be connected to the positive output of FIG. 11, and the base of transistor 801 and the base of transistor 814 would be connected to the negative output of FIG. 11. Similarly, pairs of the remaining transistors of sets 821 and 822 would be connected to transistors pairs such as the transistor 715 and 716 pairs of FIG. 11. Each pair of transistors such as the transistors 715 and 716 defines one coefficient of the matrix B. The current in each pair of the transistors in FIG. 12 remains 2I in total, but divides in proportions equal to those of the pair of transistors such as transistors 715 and 716 to which the pair is connected.

Not only does the direct current divide in this way, but also the alternating components superimposed on the direct current when a signal is applied to the bases of transistors 816 and 819 divide in this manner to a high degree of accuracy. These signals are in antiphase; thus, when the $\pm$ inputs at a given input are equal the signal reaching the associated output by way of the associated transistor in set 821 is precisely canceled by the signal reaching this output from the associated transistor in set 822. If however the voltages are unbalanced, the currents reaching the associated output from a transistor in set 821 will be different than the current reaching this output from the associated transistor in set 822, but the total current taken by a pair as defined above is still 2I so none of the other currents are effected.

This operation of the circuitry of FIG. 12 may be more apparent if a specific input such as the $b_{11}$ input is specifically considered. If the voltages on $+b_{11}$ and $-b_{11}$ are equal, the signal current reaching output $L''_{F1}+$ by way of transistor 800 is precisely canceled by the antiphase signal current reaching this output from transistor 814 and the current in each of the transistors 131 and 132 is I making a total current of 2I in this pair. If on the other hand the voltages are unbalanced by an amount corresponding to the coefficient $b_{ij}$, the current reaching output $L''_{F1}+$ via transistor 800 is greater than the current via transistor 814 in just the proportions as set by this value, and the antiphase current in $L''_{F1-}$ is similarly in the right proportion. The total current in transistors 800 and 801 is still 2I so, as mentioned above, none of the other currents are affected. Thus, each of the four pairs of voltages applied to the bases of the sets 820 and 821 splits up the current 2I and the corresponding signal components to its pair of transistors in the correct proportion independently of the others and supplies the correct output current to the associated output bus. The gain is determined by the values of resistors 817 and 818. In order to achieve low distortion, a high input impedance and good signal handling capacity, it may be necessary to replace transistors 816 and 819 with compound devices. However, transistors 816 and 819 alone do provide satisfactory operation in most instances.

FIG. 12 shows suitable circuitry for the multiplier blocks 416 through 419 of FIG. 8. However, other circuitry can also be used. For example, the matrix multiplier can be fabricated by using sixteen commercially available analog multipliers such as the Motorola MC1495 devices along with additional amplifiers to provide the direct input-to-output links corresponding to the identity matrix I of equation (12).

From the foregoing, it should be apparent that this invention by consideration of the mathematical relationships between the signals from a quadraphonic matrix decoder and the devising of suitable multiplying matrices provides a method for effectively canceling transferred signals without affecting the total power output of the loudspeakers according to the direction of the predominant sound source from moment to moment. This method of enhancing the directional content of audio information is accomplished by practical circuitry of some complexity. The relatively complex circuitry can, however, be constructed from commercially available components or can be fabricated in the form of a special purpose monolithic integrated circuit. Because the mathematical relationships differ for different quadraphonic systems, the precise details of the circuits of the invention will vary from system to system. However, from the foregoing description of the invention including the mathematical principles involved, it should be apparent that it is perfectly feasible to switch from one quadraphonic system to another without difficulty. Further, while the invention has been described in detail with respect to quadraphonic sound systems, it should be apparent that this invention can be utilized to enhance any signals having directional information. In other words, the four signals from the matrix decoder 12 could come from some device other than a second recording and this invention would enhance the directionality of such signals. Thus, this invention broadly provides means for detecting and processing the direction information contained in signals having directional information in such a manner as to enhance this direction information prior to application to the end device or devices. In a quadraphonic sound system, these end devices are, of course, loudspeakers.

While a specific embodiment of the invention and specific embodiments of the circuits that may be utilized to carry out the invention have been specifically described, it will be apparent to those skilled in the art that various changes and modifications may be made to the invention as described without departing from the spirit and scope of the invention as defined in the claims. For example, the specific circuits shown in FIGS. 2, 3 and 4 for detector 103 of FIG. 1 are amplitude detection circuits; however, where the signals from decoder 102 of FIG. 1 are phase related, detector 103 could be a phase detector. The phase detector would provide the directional control signals to processor 104. Thus, the detector 103 could include either phase detection or amplitude detection or a combination of both types if this invention is utilized in systems in which the signals are phase related. No specific circuitry is shown for a phase detector since phase comparators which would be used in such a detector are well known in the art.

What is claimed is: directional

1. A system for enhancing the directional information content of a plurality of input signals containing directonal information to produce a plurality of output signals by means of a matrix multiplication process, comprising:

a. detector means for providing a plurality of direction control signals in response to said plurality of signals containing directional information;

b. processor means for receiving said plurality of direction control signals and for providing, in response to said received plurality of direction control signals, a plurality of coefficient signals, the value of each of said coefficient signals at any time being determined by the values of said plurality of direction control signals; and c. matrix multiplication means for multiplying said plurality of input signals containing directional information by said plurality of coefficient signals, in accordance with the mathematical convention of multiplication of a vector by a matrix, to produce said plurality of output signals, the values of said plurality of coefficients being such that when said plurality of input signals is multiplied by said plurality of coefficient signals to produce said plurality of output signals, the predominant directional information contained in said plurality of input signals is substantially removed from all output signals other than those in which said predominant directional information should appear while the total effective power in the output signals due to every component of directional information present in the input signals is simultaneously maintained substantially unchanged.

2. The system as defined in claim 1 wherein said detector includes gain control circuitry for providing a gain control voltage and a reference voltage.

3. The system as defined in claim 1 wherein said detector includes a plurality of amplitude detectors.

4. The system as defined in claim 1 wherein said processor includes a signal attack and decay control circuitry.

5. The enhancement system as defined in claim 4 wherein said attack and decay circuitry comprises separate charge storage means associated wih each of said plurality of direction control signals, each of said charge storing means being charged by its associated direction control signal if only that associated direction control signal is present at a given time and retaining said charge for a given duration of time after said associated direction control signal ceases; and means to discharge a charged storage means when a direction control signal not associated with that charged storage means arises before the end of said duration of time.

6. The enhancement system as defined in claim 5 wherein means are provided with each of said separate charge storage means for limiting the charge that can be stored.

7. The enhancemment system as defined in claim 6 wherein each of said separate charge storage means is a capacitor.

8. The system as defined in claim 1 wherein said plurality of signals containing directional information are first, second, third and fourth composite signals and said plurality of output signals are first, second, third and fourth output signals.

9. The system as defined in claim 8 wherein said plurality of coefficient signals does not exceed sixteen in number.

10. The system as defined in claim 9 wherein said coefficient signals represent the coefficients of a matrix of dimension four by four as defined in mathematics.

11. The system as defined in claim 10 wherein said matrix multiplier means includes first, second, third and fourth composite multipliers.

12. The system as defined in claim 11 wherein said processor means includes signal attack and decay control circuitry.

13. The system as defined in claim 12 wherein said plurality of direction control signals does not exceed ten in number.

14. The system as defined in claim 13 wherein said detector means includes gain control circuitry for providing a gain control voltage and a reference level voltage.

15. In combination with a sound system which reproduces on four separate speakers four audio information signals contained in first, second, third and fourth composite signals derived from two other composite signals, each of said first, second, third and fourth composite signals including a combination of at least three of four said audio information signals with preselected amplitude and phase relationships, a system for enhancing the directional information content of said first, second, third and fourth composite signals to produce first, second, third and fourth output signals by means of a matrix multiplication process, comprising:

a. detector means for producing a plurality of direction control signals in response to said first, second, third and fourth composite signals;

b. processor means having a plurality of inputs equal in number to said plurality of direction control signals for producing in response to said plurality of direction control signals a plurality of matrix coefficient signals, the value of each of said coefficient signals at any time being determined by the values of said plurality of direction control signals; and, c. matrix multiplier means for multiplying said first, second, third and fourth composite signals by said plurality of coefficient signals, in accordance with the mathematical convention of multiplication of a vector by a matrix, to produce said first, second, third and fourth output signals, the values of said plurality of coefficient signals being such that when said first, second, third and fourth composite signals are multiplied by said plurality of coefficient signals to produce said first, second, third and fourth output signals, the predominant directional information contained in said first, second, third and fourth composite signals is substantially removed from all output signals other than those in which said predominant directional information should appear while the total effective power in the output signals due to every component of directional information present in said first, second, third and fourth composite signals is simultaneously maintained substantially unchanged.

16. The enhancement system as defined in claim 15 wherein said plurality of matrix coefficient signals does not exceed sixteen in number.

17. The enhancement system as defined in claim 15 wherein said coefficient signals represent the coefficients of a matrix of dimension four by four as defined in mathematics.

18. The enhancement system as defined in claim 17 wherein said matrix multiplier includes four separate composite multipliers.

19. The enhancement system as defined in claim 18 wherein each of said four composite multipliers comprises a first set of eight current devices; a second set of eight current devices; four pairs of input terminals for receiving the negative and positive components of four of said matrix coefficient signals; means to couple a different one of said current devices of both said first and second set of eight current devices to each terminal of four pairs of input terminals; first, second, third and fourth pairs of output terminals, each pair of said first, second, third and fourth pairs of output terminals providing a negative and positive terminal; means for coupling a different one of said current devices of both said first and second set of eight current devices to each terminal of said first, second, third and fourth pairs of output terminals to provide first, second, third and fourth negative-positive current signal pairs to said first, second, third and fourth pairs of output terminals respectively; a pair of voltage controlled current sources; means to apply one of said first, second, third and fourth composite signals to said pair of voltage-controlled current sources; means to couple one of said pair of voltage controlled current sources to said first set of eight current devices; and means to couple the other one of said pair of voltage controlled current sources to said second set of eight current devices.

20. The enhancement system as defined in claim 19 wherein said matrix multiplier further comprises first, second, third and fourth current to voltage converters; and wherein means are provided to couple a different pair of said four pairs of output terminals of each of said multipliers to each of said first, second, third and fourth current to voltage converters.

21. The enhancement system as defined in claim 20 wherein said matrix multiplier further includes first, second, third and fourth current amplifiers; means to couple said first, second, third and fourth composite signals to the input of said first, second, third and fourth current amplifiers respectively; and means to couple the output of said first, second, third and fourth current amplifiers to the input of said first, second, third and fourth current to voltage converters respectively.

22. The enhancement system as defined in claim 21 wherein said processor means includes attack and decay circuitry.

23. The enhancement system as described in claim 22 wherein said attack and decay circuitry comprises a plurality of individual attack and decay circuits.

24. The enhancement system as defined in claim 23 wherein said processor further includes a plurality of processor signal combiners; and means to apply the output of more than one of said attack and decay circuits to each of said processor signal combiners to provide a different one of said plurality of matrix coefficient signals at the output of each of said plurality of processor signal combiners.

25. The enhancement system as defined in claim 24 wherein said attack and decay circuitry comprises separate charge storage means associated with each of said plurality of direction control signals, each of said charge storing means being charged by its associated direction control signal if only that associated direction control signal is present at a given time and retaining said charge for a given duration of time after said associated direction control signal ceases; and means to discharge a charged storage means when a direction control signal not associated with that charged storage means arises before the end of said duration of time.

26. The enhancement system as defined in claim 25 wherein means are provided with each of said separate charge storage means for limiting the charge that can be stored.

27. The enhancement system as defined in claim 26 wherein each of said separate charge storage means is a capacitor.

28. The enhancement system as defined in claim 27 wherein said plurality of control signals does not exceed ten in number.

29. The enhancement system as defined in claim 28 wherein said processor means includes gain control circuitry for generating a gain control voltage and a reference level voltage.

30. The enhancement system as defined in claim 29 wherein said detector means comprises first, second, third and fourth variable gain amplifiers each having a signal input, a gain control voltage input and an output; means to couple said first, second, third and fourth composite signals to the signal input of said first, second, third and fourth variable gain amplifiers respectively; first, second, third and fourth attenuators each having an input and an output; means to couple the output of said first, second, third and fourth variable gain amplifiers to said input of said first, second, third and fourth attenuators respectively; a plurality of signal combiners each having an input and an output; means to couple the output of at least two of said first, second, third and fourth variable gain amplifiers to the input of each of said plurality of signal combiners; a plurality of rectifiers equal in number to the sum of said plurality of signal combiners and said first, second, third and fourth attenuators, each of said plurality of rectifiers having an input and an output; means to couple said output of a different one of said plurality of signal combiners and said first, second, third and fourth attenuators to said input of each of said plurality of rectifiers; means coupled to the said output of all of said plurality of rectifiers for deriving a control voltage; means to apply said control voltage to said gain control input of each of said first, second, third and fourth variable amplifiers as a gain control voltage; a plurality of smoothing filters equal in number to said plurality of rectifiers, each of said smoothing filters having an input and an output; means to couple said output of a different one of said plurality of rectifiers to said input of each said plurality of smoothing filters; a plurality of comparators each having first and second inputs and an output; means to apply said control voltage to said first input of all of said plurality of comparators as a reference level voltage; and means to couple said output of a different one of said plurality of said smoothing filters to said second input of each of said plurality of comparators whereby each one of said plurality of comparators provides on its respective output one of said plurality of direction control signals, whenever the input signal at its first input exceeds that at its second input.

31. The enhancement system as defined in claim 30 wherein said means for deriving a control voltage comprises a plurality of resistors equal in number to said plurality of rectifiers; a summing amplifier having an input and an output; means to couple one end of all of said plurality of resistors to said input of said summing amplifier; means to couple the output of a different one of said plurality of rectifiers to the other end of each resistor of said plurality of resistors, a unity gain inverter having an input and an output; means to couple said output of said summing amplifier to said input of said unity gain inverter whereby said control voltage is provided on said output of said unity gain inverter.

32. A method for enhancing the directional information content of a plurality of input signals containing directional information to produce a plurality of output signals by means of a matrix multiplication process comprising the steps of:

a. deriving from said plurality of signals containing directional information a plurality of directional control signals;

b. deriving in response to said plurality of directional control signals a plurality of coefficient signals, the value of each coefficient signal at any given time being determined by the values of said plurality of direction control signals; and c. multiplying said plurality of input signals containing directional information by said plurality of coefficient signals, in accordance with the mathematical convention of multiplication of a vector by a matrix, to produce said plurality of output signals, the values of said plurality of coefficient signals being such that when said plurality of input signals is multiplied by said plurality of coefficient signals to produce said plurality of output signals, the predominant directional information contained in said plurality of input signals is substantially removed from all said output signals other than those in which said predominant directional information should appear while the total effective power in said output signals due to every component of directional information in said input signals is simultaneously maintained substantially unchanged.

33. A method for enhancing the directional information content of first, second, third and fourth composite signals by a matrix multiplication process to produce first, second, third and fourth output signals comprising the steps of:

a. deriving from said first, second, third and fourth composite signals a plurality of direction control signals;

b. deriving from said plurality of direction control signals a plurality of matrix coefficient signals, the value of each of said plurality of matrix coefficient signals at any given time being determined by the values of said plurality of direction control signals;

c. multiplying said first, second, third and fourth composite signals considered as a time-varying vector of dimension four as defined in mathematics by said plurality of matrix coefficient signals, in accordance with the mathematical convention of multiplication of a vector by a matrix, to produce first, second, third and fourth output signals in which the predominant directional information contained in said first, second, third and fourth composite signals is substantially removed from all of said output signals except those output signals in which it should appear while at the same time the total effective power in said output signals due to every component of directional information present in said first, second, third and fourth composite signal is maintained substantially unchanged.

* * * * *